US006832831B2

(12) United States Patent
Shima et al.

(10) Patent No.: US 6,832,831 B2
(45) Date of Patent: Dec. 21, 2004

(54) IMAGE FORMING APPARATUS

(75) Inventors: Kazunobu Shima, Wakayama (JP); Hidetoshi Nishikawa, Wakayama (JP); Masazumi Ishikawa, Wakayama (JP); Kiyotaka Arai, Wakayama (JP); Yuji Yamamoto, Wakayama (JP); Masasuke Funase, Wakayama (JP); Kazuo Nagaosa, Wakayama (JP); Masaki Nakamoto, Wakayama (JP); Masanori Inoshita, Wakayama (JP)

(73) Assignee: Noritsu Koki Co., Ltd., Wakayama-Ken (JP)

( * ) Notice: Subject to any disclaimer, the term of this patent is extended or adjusted under 35 U.S.C. 154(b) by 0 days.

(21) Appl. No.: 10/365,200

(22) Filed: Feb. 12, 2003

(65) Prior Publication Data

US 2003/0151652 A1 Aug. 14, 2003

(30) Foreign Application Priority Data

| | | |
|---|---|---|
| Feb. 14, 2002 | (JP) | 2002-036981 |
| Apr. 3, 2002 | (JP) | 2002-100889 |
| May 14, 2002 | (JP) | 2002-138747 |
| Aug. 5, 2002 | (JP) | 2002-227613 |
| Dec. 4, 2002 | (JP) | 2002-352596 |

(51) Int. Cl.[7] ..... B41J 2/01
(52) U.S. Cl. ..... 347/102; 101/424.1; 101/488
(58) Field of Search ..... 347/102; 101/424.1, 101/488

(56) References Cited

U.S. PATENT DOCUMENTS

| | | | | |
|---|---|---|---|---|
| 5,954,440 A | | 9/1999 | Leys et al. | |
| 5,970,304 A | * | 10/1999 | Stemmle | 399/364 |
| 6,120,199 A | | 9/2000 | Takekoshi | |
| 6,439,712 B1 | * | 8/2002 | Mizutani et al. | 347/102 |
| 6,523,948 B2 | * | 2/2003 | Matsumoto et al. | 347/102 |

FOREIGN PATENT DOCUMENTS

| | | | | |
|---|---|---|---|---|
| EP | 0 538 071 A | | 4/1993 | |
| EP | 0 925 945 A | | 6/1999 | |
| JP | 06079868 A | * | 3/1994 | B41J/2/015 |
| JP | 08-311782 | | 11/1996 | |
| JP | 08 311782 A | | 11/1996 | |
| JP | 10-016188 | | 1/1998 | |
| JP | 10-230589 | | 9/1998 | |
| JP | 10-297197 | | 11/1998 | |
| JP | 2000302302 A | * | 10/2000 | B65H/20/24 |

* cited by examiner

*Primary Examiner*—Stephen D. Meier
*Assistant Examiner*—Ly T Tran
(74) *Attorney, Agent, or Firm*—Fulbright & Jaworski L.L.P.

(57) ABSTRACT

An image forming apparatus includes a printing unit having a print head for applying ink to a surface layer of a recording medium transported thereto; a loop-forming unit capable of temporarily storing the recording medium discharged from the printing unit; and a heating unit for heating the recording medium fed from the loop-forming unit for fixing the ink applied to the surface layer onto its fixing layer. The heating unit includes a preliminary heating subunit for heating the recording medium from a normal temperature level to a ink fixing temperature level, a main heating unit for heating the recording medium at the ink fixing temperature level and a slow cooling subunit for slowly cooling the recording medium to the normal temperature level.

11 Claims, 17 Drawing Sheets

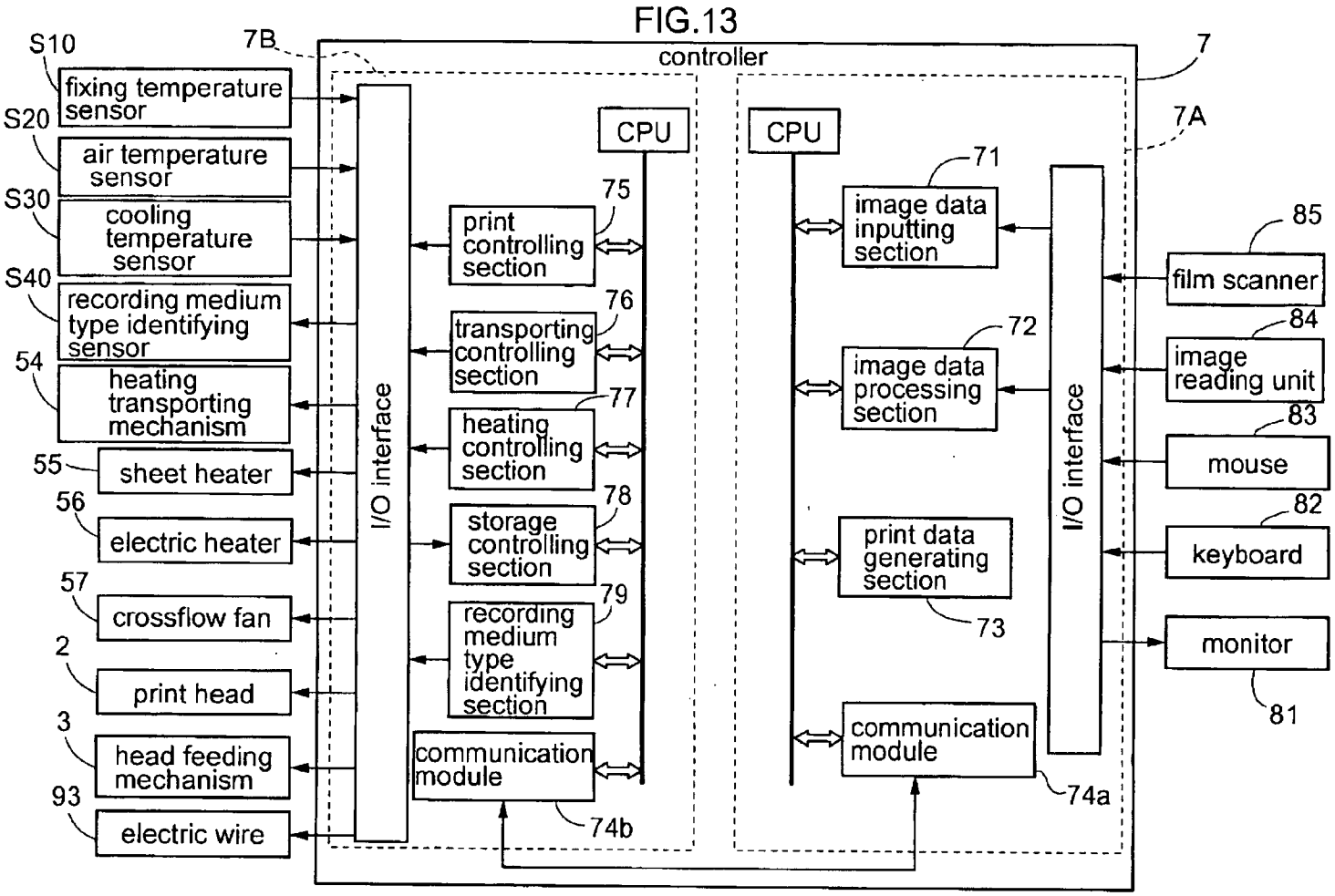
FIG.13
controller
7
7A
7B
film scanner
85
image reading unit
84
mouse
83
keyboard
82
monitor
81
I/O interface
CPU
image data inputting section
71
image data processing section
72
print data generating section
73
communication module
74a
CPU
print controlling section
75
transporting controlling section
76
heating controlling section
77
storage controlling section
78
recording medium type identifying section
79
communication module
74b
I/O interface
fixing temperature sensor
S10
air temperature sensor
S20
cooling temperature sensor
S30
recording medium type identifying sensor
S40
heating transporting mechanism
54
sheet heater
55
electric heater
56
crossflow fan
57
print head
2
head feeding mechanism
3
electric wire
93

IMAGE FORMING APPARATUS

BACKGROUND OF THE INVENTION

1. Field of the Invention

The present invention relates to an image forming apparatus including a print head for applying ink to a surface layer of a recording medium transported thereto and a heating unit for heating this recording medium for fixing the ink applied to the surface layer by the print head onto its fixing layer.

2. Description of the Related Art

An exemplary conventional technique relating to the above field of art is disclosed in Japanese patent application "Kokai" No: Hei. 10-297197. According to this, a metal substrate includes a coloring ground layer acting also as a rust-preventive layer, a transparent resin layer as an optical transparent resin layer formed over the coloring ground layer, the resin layer being made of acrylic resin, polyester resin, urethane resin etc., and an inkjet receiving layer formed over the resin layer and made of e.g. porous alumina. After application of a sublimating ink or pigment on the inkjet receiving layer by an inkjet printing, the sublimating pigment is heated in a heating furnace or by a hot press, whereby the sublimating pigment in the inkjet receiving layer is sublimed into the transparent resin layer. Then, the inkjet receiving layer is removed to obtain an ornamental metal body having a colored pattern fixedly formed within the transparent resin layer.

According to further art disclosed by Japanese patent application "Kokai" No: 2001-105638, sublimating ink is transferred from an ink ribbon onto a surface of a recording sheet. In order to heat and fix the ink on the sheet, the sheet is charged into a heater box, in which the sheet is advanced and heated between a press roll and a heat roll opposed to each other with a small gap therebetween or between a heat roll and a conveyer belt disposed along a portion of the peripheral face of the heat roll, and then the sheet is discharged from the heater box immediately.

Further, in the field of textile printing, according to an exemplary technique disclosed by Japanese patent application "Kokai" No: Hei. 08-311782, dye is applied to a textile by the inkjet printing method. Then, in order to reinforce the fixing of the dye and also to improve its color development, the textile is charged into a heater device to be heated therein. Then, the textile is discharged from the device immediately to be cooled at the normal temperature.

Still further, Japanese patent application "Kokai" No: Hei. 10-16188 discloses an image forming apparatus. According to this, first, a primary image is formed on a thermal transfer sheet by e.g. an inkjet printer. Then, this thermal transfer sheet having the image formed thereon is laid over a recording sheet and these sheets are pressed and heated together, whereby the image (ink) formed on the thermal transfer sheet will be sublimed by the heat and transferred onto an ink fixing layer of the recording sheet, thus forming a secondary image thereon. With this, a finished printed product is obtained.

Another image forming apparatus is known from Japanese patent application "Kokai" No: Hei. 10-230589. According to this, a laminated material layer is provided in advance on an ink fixing layer of a recording sheet. Then, an image is formed on the laminated material layer by e.g. an inkjet printer. Then, the resultant sheet is pressed and heated by heat rolls, thereby to make the laminated material layer transparent and also to fix the ink pigment on the fixing layer. With this, a finished printed product is obtained.

With these image forming apparatuses, sublimating ink is discharged against the recording medium which usually is being transported along a sub-scanning direction, so that an image is formed thereon with ink droplets (here, these will be referred to as "un-sublimated print dots"). Then, during the subsequent heat fixing process, these ink droplets are heated to sublime, so that the sublimed ink pigment (referred to here as "sublimed print dots") is fixed in the fixing layer of the recording medium, whereby a final printed image formed of the sublimed print dots with vivid color development is obtained.

In order to maintain good quality of printed product as a finished product regardless of the print size, it is essential that the heating process be effected on the recording medium applied with the ink at an appropriate timing and with appropriate heating pattern. In this regards, it should be noted that these types of image forming apparatuses are often installed in a printing service shop or a photography shop, so the apparatus needs to be formed as compact as possible.

SUMMARY OF THE INVENTION

In view of the above-described state of the art, with the image forming apparatus described at the onset as being its starting technique, a primary object of the present invention is to provide a compact image forming apparatus capable of effecting an appropriate heating process in a smooth manner on various kinds of recording media transported from the printing unit, including a recording media of the standard poster size to a very long recording medium having a length of over 10 meters for production of a huge commercial advertisement billboard or the like.

For accomplishing the above-noted object, according to the present invention, an image forming apparatus comprises a printing unit having a print head for applying ink to a surface layer of a recording medium transported thereto; a loop-forming unit capable of temporarily storing the recording medium discharged from the printing unit; and a heating unit for heating the recording medium fed from the loop-forming unit for fixing the ink applied to the surface layer onto its fixing layer; wherein said heating unit includes at least two heating areas which are adjusted to heating temperatures different from each other.

With the above construction, the recording medium introduced into the heating unit is heated in the at least two heating areas adjusted to different heating temperatures. Hence, the recording medium is subjected to a main heating condition in which the medium is heated at the ink fixing temperature for sublimation of the ink (generally at 150° C. or higher) and a supplementary heating condition in which the medium is heated to a temperature lower than this ink fixing temperature. Namely, by appropriately avoiding rapid cooling or rapid heating, it becomes possible to alleviate thermal load to which the recording medium is exposed. Especially, when the heating unit is adapted for effecting a supplementary heating prior to the main heating, the recording medium is to be heated first to the lower temperature than the ink fixing temperature and then heated to the ink fixing temperature, whereby rapid increase in the temperature may be avoided when the recording medium is heated to the fixing temperature. As a result, with effective elimination of disadvantage due to rapid heating, a finished printed product having high quality may be obtained.

Further, according to one preferred embodiment of the invention, in order to create an advantageous heating condition within the heating unit, the heating unit includes a preliminary heating subunit for heating the recording medium from a normal temperature level to a ink fixing temperature level, a main heating unit for heating the recording medium at the ink fixing temperature level and a slow cooling subunit for slowly cooling the recording medium to the normal temperature level. With this construction, the recording medium which has been heated in the heating units is slowly cooled from the ink fixing temperature (generally 150° C. or higher) to the normal temperature (room temperature) by the slow cooling subunit. As a result, it is possible to restrict occurrence of deformation such as wrinkles in the recording medium which would occur otherwise if the medium were discharged suddenly from the heating unit to the outside due to rapid cooling thereof from the ink fixing temperature to the room temperature. Consequently, there is obtained a finished printed product of high quality with minimum wrinkles.

Preferably, said each subunit includes a transport guide member for coming into face contact with the recording medium and a heater disposed to be able to transfer its heat to the transport guide member. With this construction, the recording medium can be heated with as uniform as possible temperature distribution while the medium is being transported. In particular, in the case of the preliminary heating subunit or the slow cooling subunit, by arranging the layout of the heater for providing the heat to its transport guide member in such a manner that the surface temperature of the transport guide member may be raised mildly along a transporting direction of the recording medium from the environment temperature (room temperature) to the ink fixing temperature or that the surface temperature may be lowered mildly along the same direction from the ink fixing temperature to the room temperature, the recording medium can be heated or slowly cooled in an uniform as well as continuous manner. In order to readily realize such effective heater layout, it will be advantageous to form the heater of an electric wire and dispose this electric wire so that its disposing density is gradually increased (in the case of the preliminary heating subunit) or gradually decreased (in the case of the slow cooling subunit) along the transporting direction.

According to one preferred embodiment of the present invention, the printing unit includes a first transporting mechanism for transporting the recording medium while the heating unit includes a second transporting mechanism for transporting the recording medium; and said loop-forming unit is capable of absorbing a transportation speed difference between the first transporting mechanism and the second transporting mechanism. With this construction, the recording medium discharged from the printing unit can be temporarily stored within the loop-forming unit. Therefore, it is possible to introduce the recording medium to the heating unit at an appropriate timing required for achievement of high-quality image and it is also possible to select the retention time of the recording medium within the heating unit from a variety of ranges. Moreover, the discharging speed of the recording medium from the printing unit need not be fixed. Instead, this discharging speed can be independent of the transport speed of the recording medium in the heating unit. These provide greater freedom in the design and adjustments of the printing unit as desired. To put it the other way around, the transport speed and/or retention time of the recording medium in the heating unit can be optimally set, independently of the discharging speed of the recording medium from the printing unit.

If the transport speed of the first transporting mechanism is set higher than the transport speed of the second transporting mechanism, the printing unit can effect a printing operation at a high speed even if the transport speed of the second transporting mechanism is set low in order to increase the retention time of the recording medium for obtaining better image quality. Particularly, in processing a very long recording medium, it is possible to avoid such inconvenience as interruption of the printing process in the middle of the same.

According to another preferred embodiment of the present invention, a cutter for cutting the recording medium is provided within the printing unit or between the printing unit and the loop-forming unit. With this, from the elongate recoding medium retained in the form of a roll in the printing unit, a necessary length of the medium can be cut as desired for use. Hence, this construction advantageously provides the capability of processing recording media of various lengths. As the cutter is disposed inside the printing unit or between the printing unit and the loop-forming unit, the recording medium can be charged into the heating unit via the loop-forming unit continuously during the cutting operation which requires keeping the recording medium temporarily still.

According to a further preferred embodiment of the invention, the printing unit, the loop-forming unit and the heating unit are detachably attached to each other. The loop-forming unit and the heating fixing unit may be integrated into a single recording medium processing unit which is detachably attachable to the printing unit. With this, it becomes possible to replace the unit with a different unit whose loop-forming unit allows accumulation of a loop of a different length or whose heating unit has a heating area having a different length. Further, it becomes also possible to detach the printing unit alone from the invention's image forming apparatus and us the unit as a standard printer for printing on a recording medium of a conventional paper or the like which does not require fixing by heating.

According to a still further preferred embodiment of the present invention, the loop-forming unit includes an intermediate transporting mechanism for sending the recording medium received from the printing unit into the heating unit; and the intermediate transporting mechanism forms a first storage section and a second storage section each operable to store the recording medium while forming a loop thereof. Preferably, the first storage section and the second storage section are disposed one after another along the transporting direction of the recording medium. With this sequential arrangement of the two storage sections, it becomes possible to continuously transfer a plurality of recording media between the printing unit and the heating unit. In this, preferably, the intermediate transporting mechanism includes a pinching transport roller set and a feed roller set, the first storage section being formed between a recording medium exit of the printing unit and the pinching transport roller set, the second storage section being formed between the pinching transport roller set and the feed roller set. With this, it becomes possible to form the loops of the recording medium formed according to movement of the pinching transport roller set on the opposed sides of the pinching transport roller set. Consequently, in spite of the large storage capacity thereof, the loop-forming unit may be formed compact. Further, in the case of a relatively short recording medium which can be accommodated within the one first storage section, by transferring the entire medium to the second storage section immediately after completion of the printing process through the pinching transport roller set, the first storage medium may be emptied to be able to receive a next recording medium. As a result, the processing speed of the printing unit may be increased.

Advantageously, the pinching transport roller set can be adapted for acting as a curl correcting roller for alleviating curling tendency of the recording medium. With this, if the recording medium as transported to the pinching transport roller set has a curling tendency since the recording medium before being fed to the printing unit was kept in the form of a roll wound about a core, such curling tendency of the recording medium can be eliminated or at least reduced by the pinching transport roller set acting also as the curl correcting roller and then transported to the heating unit. Accordingly, it becomes possible to avoid occurrence of inappropriate transportation (including such phenomenon as jamming of the recording medium within the transporting mechanism which needs to be avoided) which would occur if the medium were sent to the heating unit with curling tendency remaining in the medium. To realize this construction, the pinching transport roller set may be constituted from a turn roller having a large diameter and a plurality of assist rollers disposed in spaced apart relationship along the peripheral face of the turn roller. With this, through the entire construction is compact, the construction allows the recording medium to be turned with a precise radius of curvature while the medium is retained by the construction reliably. For alleviating the curling tendency of the recording medium, it is preferred that the winding angle of the recording medium to the turn roller exceed 100 degrees.

Further and other features of the invention will become apparent upon reading the following detailed description of the preferred embodiments thereof with reference to the accompanying drawings.

BRIEF DESCRIPTION OF THE DRAWINGS

FIG. 13 is a functional block diagram illustrating various functions of a controller.

DESCRIPTION OF THE PREFERRED EMBODIMENTS

Figure 1:
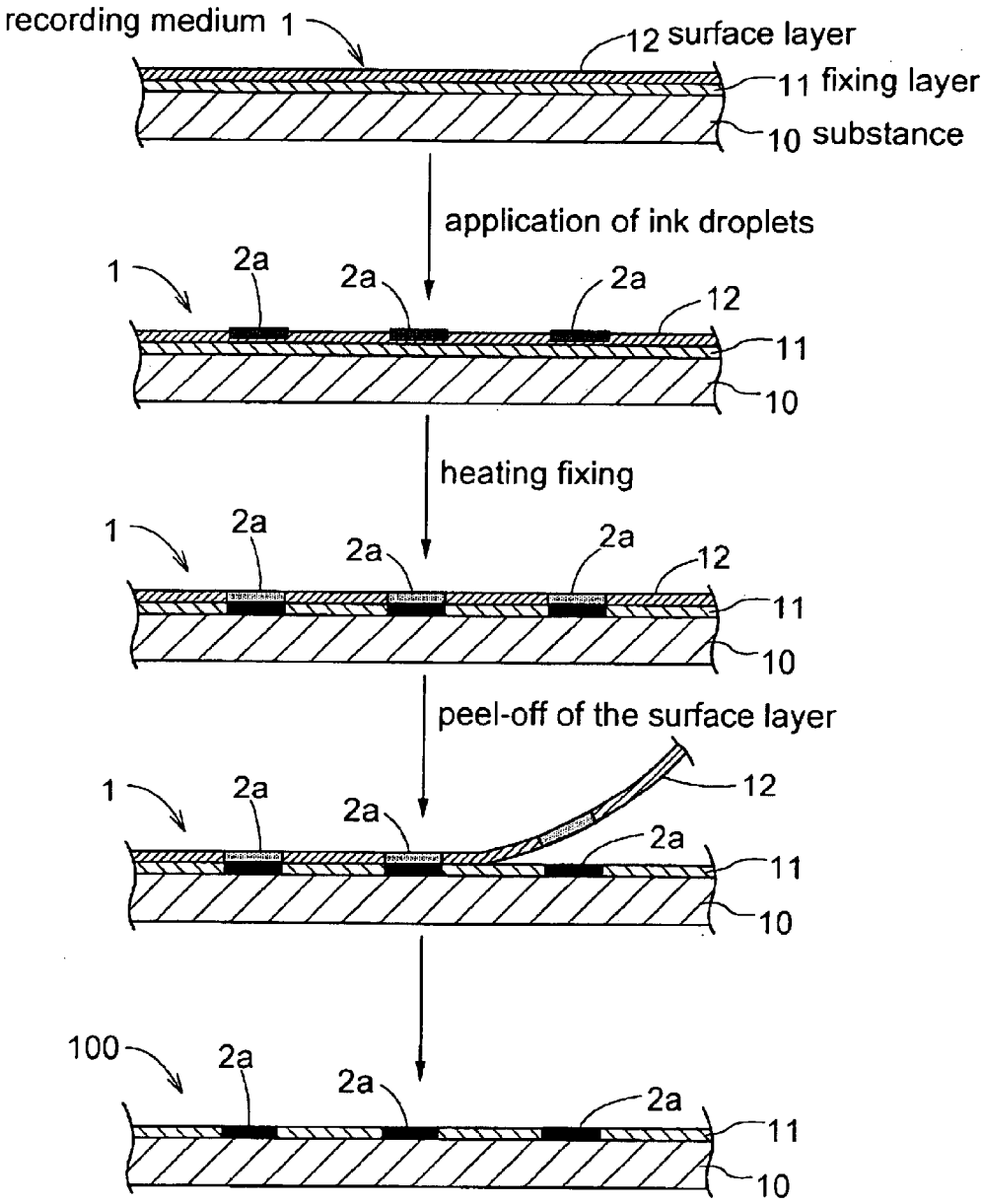
FIG. 1 is a section view showing an example of recording medium to be processed by the present invention.

First, an example of a recording medium 1 to be processed by the invention will be described with reference to FIG. 1. This recording medium 1 includes a substrate 10 made of a film sheet of e.g. PET (polyethylene terephthalate), a fixing layer 11 formed of e.g. urethane resin and placed over the surface of the substrate 10 for fixing therein ink, that is, ink pigment, and a surface layer 12 placed on the surface of the layer 11 and acting as a permeation layer allowing permeation of the ink therethrough. In case the surface of the substrate 10 has a property allowing direct fixation of the ink pigment thereon, the fixing layer 11 may be omitted. In use, sublimating ink droplets are applied by e.g. an inkjet printer to the surface layer 12 of this recording medium 1 to form thereon a printed image constituted from un-sublimated print dots, after which, when heated to an appropriate temperature, the ink droplets (un-sublimated print dots) applied on the surface layer 12 begin to sublime and permeate the surface layer 12 to reach the underlying fixing layer 11, so that the ink pigment, now as sublimated print dots, is fixed within the fixing layer 11. Accordingly, by removing or "peeling off" the surface layer 12, there will be obtained, as a final printed product 100, an image recorded sheet having high gloss and high image definition bearing the printed image formed of the sublimated print dots in its fixing layer 11. Namely, in this heating sublimating process, the ink pigment applied as un-sublimated print dots to the surface layer 12 permeates through the surface layer 12 to reach the fixing layer 11, where the pigment as sublimated print dots forms the printed image. Incidentally, as this recording medium requires, at the last stage, removal of the surface layer 12 from the fixing layer 11 or the substrate 10, it will be advantageous to provide a releasing agent therebetween.

Next, an exemplary image forming apparatus for producing the final printed product 100 with using the above-described recording medium 1 will be described with reference to FIG. 2 and FIG. 3. As shown, this image forming apparatus consists mainly of a printing station PS and an operator's station OS.

The printing station PS includes an inkjet type printing unit PU, a loop-forming unit LU for temporarily holding the recording medium 1 bearing a printed image formed of un-sublimated print dots by the printing unit PU, and a heating fixing unit HU for applying thermal energy to the recording medium 1 sent from the loop-forming unit LU to produce a printed image formed of sublimated print dots. The heating fixing unit HU includes a preliminary heating subunit PR for heating the recording medium 1 with an appropriate temperature gradient to a sublimating fixing temperature, a main heating subunit R for heating the recording medium 1 at the sublimating fixing temperature, and a slow cooling subunit CU for slowing cooling the recording medium 1 discharged from the main heating subunit R to a normal temperature (room temperature).

Incidentally, the loop-forming unit LU provided between the printing unit PU and the heating fixing unit HU serves to absorb a speed difference existing between a relatively low transport speed of the recording medium 1 provided by the heating fixing unit HU and a relatively high average transport speed of the medium 1 provided by the printing unit PU. The printing unit PU, loop-forming unit LU and the heating fixing unit HU are provided as separate units detachably connectable to each other. The slow cooling subunit CU is attached to the heating fixing unit HU.

Figure 4:
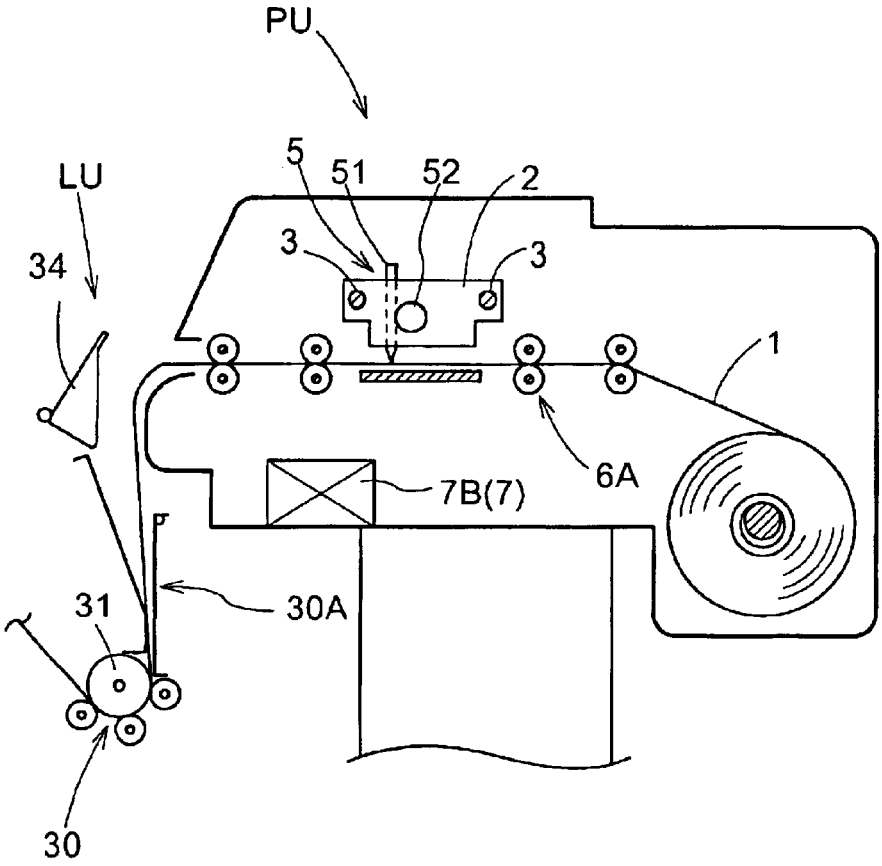
FIG. 4 is a schematic section showing a construction of a printing unit included in the printing station.

As can be seen from FIG. 4, within the printing unit PU, a sheet transport mechanism 6A transports the recording medium 1 while unwinding this recording medium 1 from an unillustrated roll-sheet cartridge in which the medium 1 is stored in the form of a roll, in such a manner that the surface layer 12, the printing surface, of the medium may be brought adjacent an ink discharging outlet of an inkjet type print head 2 as an example of a print head. The print head 2 is mounted to be movable back and forth by a head feeding mechanism 3 along a direction traversing the transporting direction of the recording medium 1, that is, along a main scanning direction. As the recording medium 1 is transported along a sub-scanning direction with each stroke of movement of the print head 2 discharging ink through its ink discharging outlet against the surface layer 12 of the recording medium 1, printed images will be formed in succession. The print head 2 includes a plurality of discharging outlet modules capable of respectively discharging inks of different principal colors in order to form a color printed image. For instance, if a color printed image of photographic quality is needed, in addition to inks of primary colors of cyan, magenta, yellow, black etc, further inks of tint colors of same kind will be generally used. The print head 2 may be a standard print head used in a conventional inkjet printer. Therefore, further description thereof will be omitted. After a printed image is formed on its surface layer 12 with the ink droplets 2a discharged from the print head 2, the recording medium 1 exits the printing unit PU to enter the loop-forming unit LU.

The recording medium 1 is provided in the form of an elongate sheet from its manufacturer. Hence, it is necessary to cut it to a size of a printed image formed thereof. To this end, a sheet cutter means 5 is provided. In this embodiment, the sheet cutter means 5 includes a cutter blade body 51 switchable between a position where the body projects toward the recording medium 1 relative to the print head 2 and a further position where the body is retracted away from the recording medium 1, and a switchover motor 52 for switching over the cutter blade body 51 between the two positions through e.g. a cam-feed or screw-feed mechanism (not shown).

Figure 2:
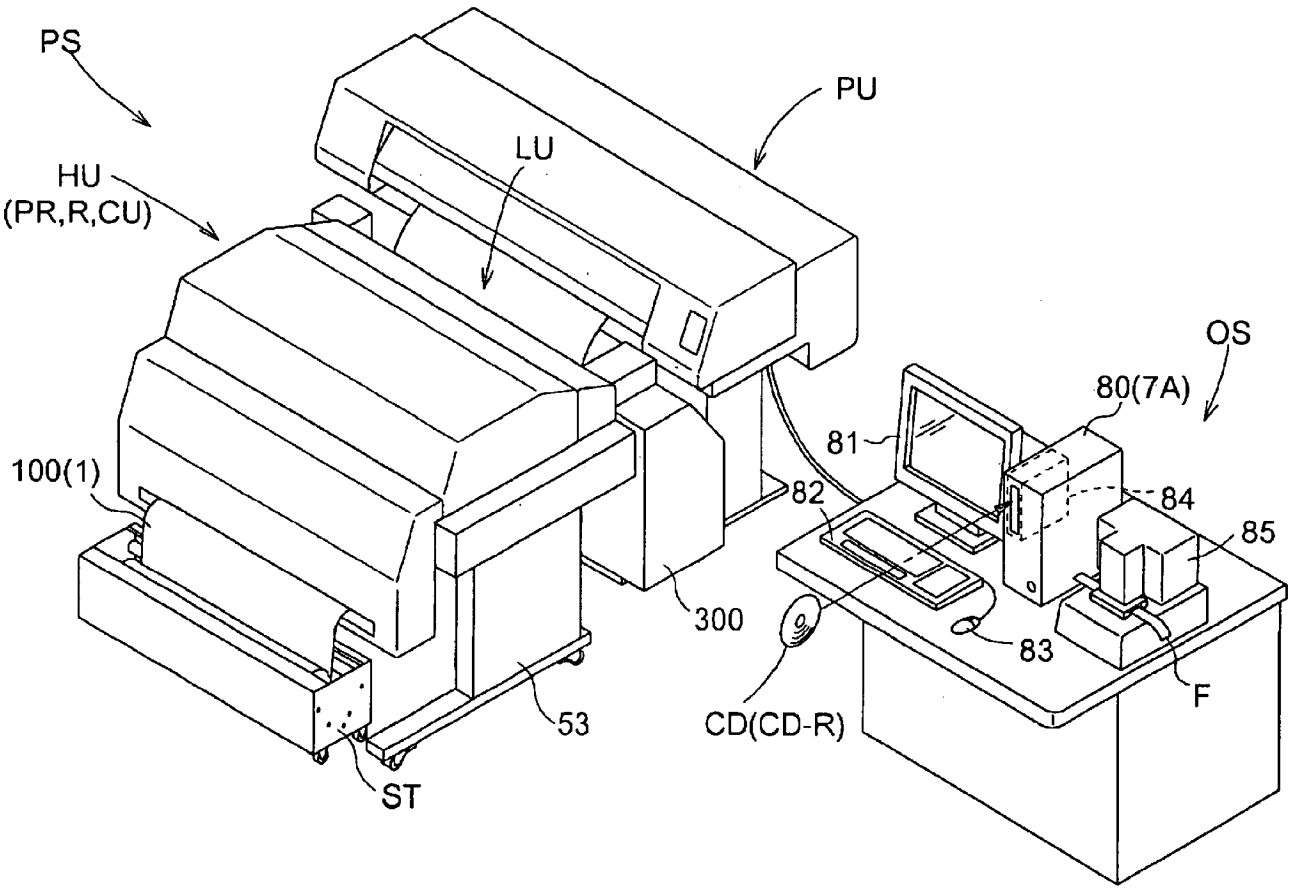
FIG. 2 is an appearance view of an image forming apparatus according to one preferred embodiment of the invention.

As shown in FIG. 2, the loop-forming unit LU includes a case body 300 connected to and between the printing unit PU and the heating fixing unit HU. Various components constituting this loop-forming unit LU are attached and supported to this case body 300. As may be apparent from FIG. 3, between an exit of the printing unit PU and an entrance of the heating fixing unit HU, that is, between a first transporting mechanism 6A and a second transporting mechanism 6B, an intermediate transporting mechanism 30 is provided. This intermediate transporting mechanism 30 includes a pinching transport roller 31 disposed downwardly of both the exit of the printing unit PU and the entrance of the heating fixing unit HU and a feed roller set 32 disposed adjacent the entrance of the heating fixing unit HU. The transporting line between the exit of the first transporting mechanism 6A and the pinching transport roller set 31 does not include drive rollers or the like and is provided as a first storage section 30A where the recording medium 1 can be formed into a loop. Similarly, the transporting line between the pinching transport roller set 31 and the feed roller set 32 is provided as a second storage section 30B.

Figure 5:
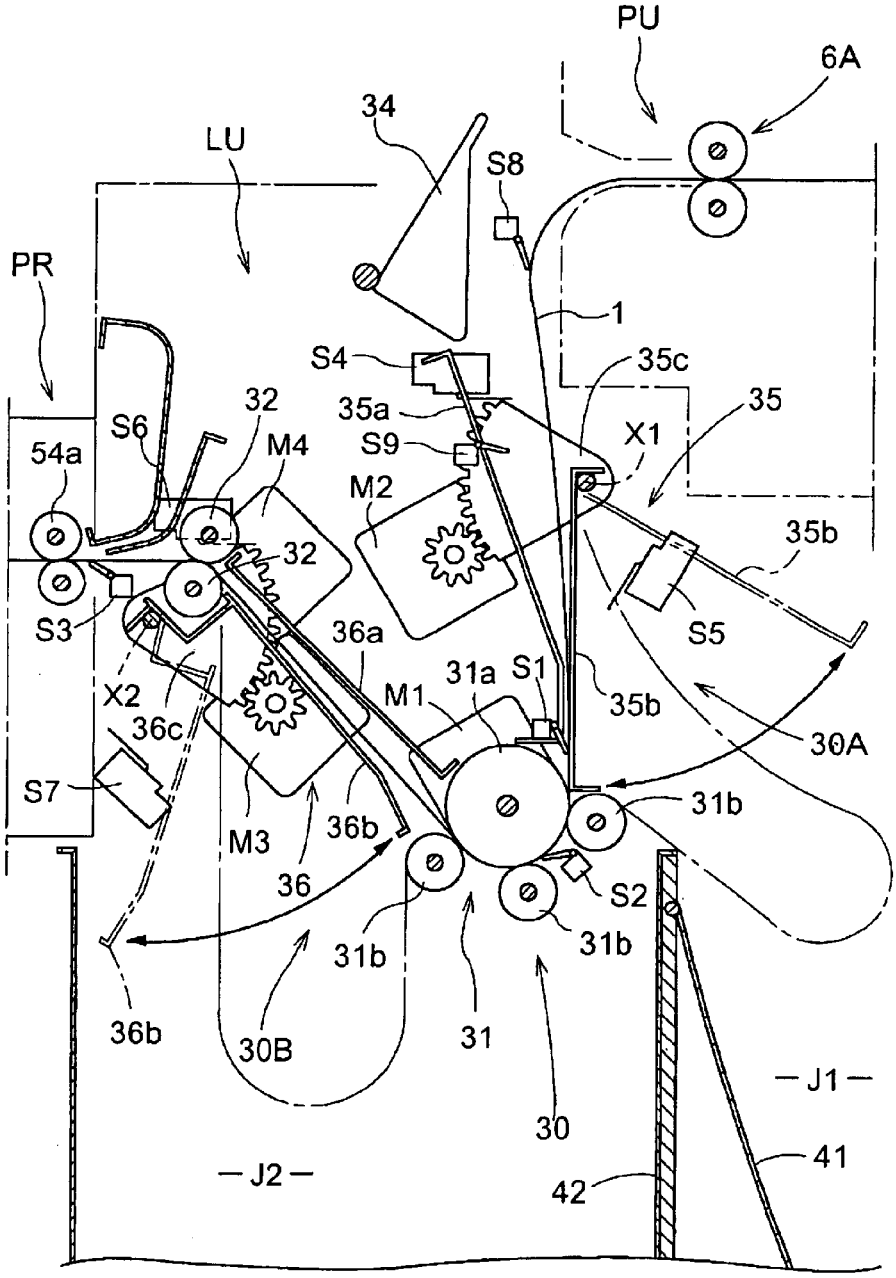
FIG. 5 is a schematic section showing a construction of a loop-forming unit.

As may be apparent from FIG. 5, the first storage section 30A includes a first guide mechanism 35 and the second storage section 30B includes a second guide mechanism 36. The first guide mechanism 35 includes a stationary guide plate 35*a* and a movable guide plate 35*b* between which the recording medium 1 can pass. When the movable guide plate 35*b* disposed transportation-wise downstream is opened, the recording medium 1 can form its loop downwardly therefrom. Similarly, the second guide mechanism 36 includes a stationary guide plate 36*a* and a movable guide plate 36*b* between which the recording medium 1 can pass. When the movable guide plate 36*b* disposed transportation-wise downstream is opened, the recording medium 1 can form its loop downwardly therefrom. That is, a first loop accumulating space J1 extends from the first storage section 30A and a second loop accumulating space J2 extends from the second storage section 30B. The first loop accumulating space J1 is delimited by a stocker sheet 41 made of cloth having anti-static electricity treatment. The second loop accumulating space J2 is delimited by a stocker box 42 made of resin.

Figure 6A:
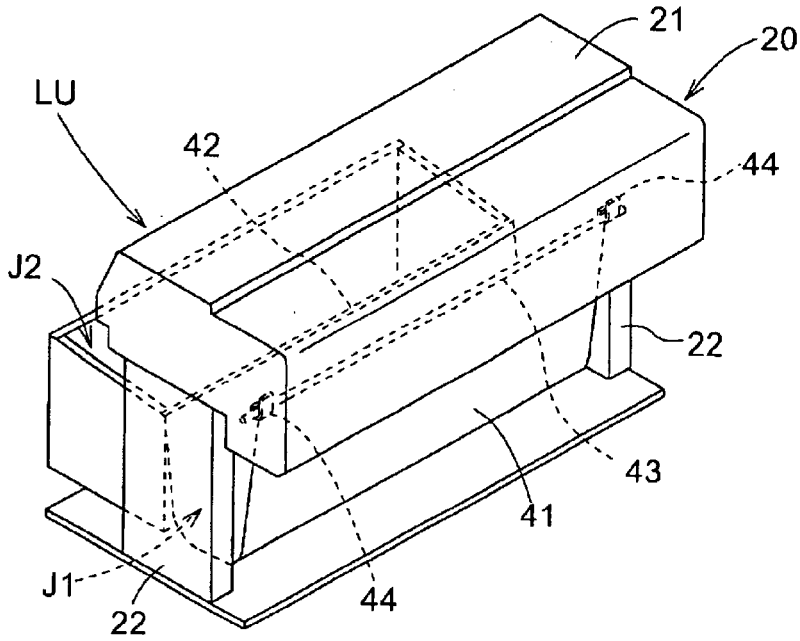
FIG. 6A is a perspective view showing a use of a stocker sheet made of cloth.
Figure 6B:
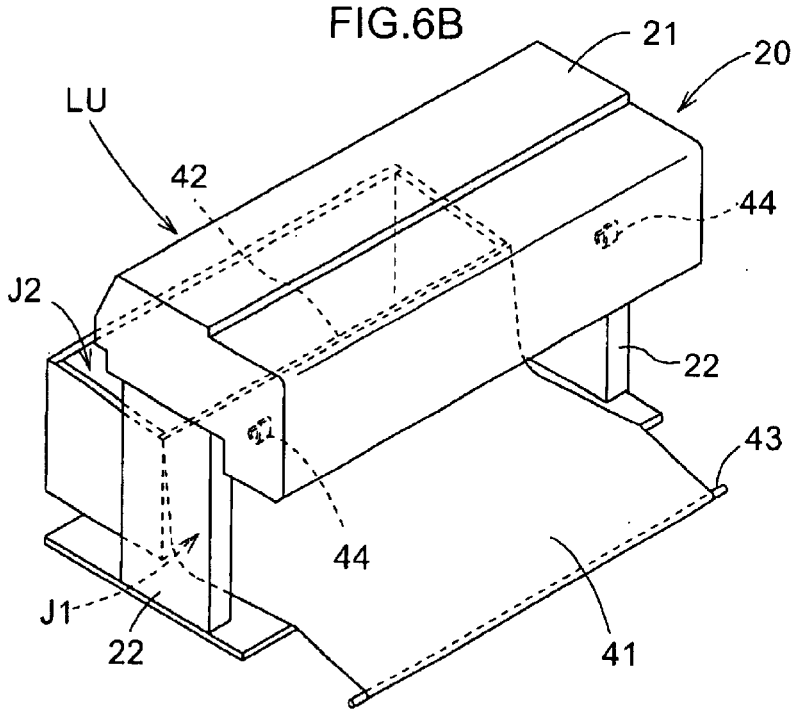
FIG. 6B is a perspective view showing a use of a stocker sheet made of cloth.

The stocker box 42 forming the boundary faces of the second loop accumulating space J2 comprises a rectangular box having a bottom face, four side walls and an open top and forms therein a rectangular accumulating space which is not deformable. On the other hand, the cloth stocker sheet 41 forming the boundary faces of the first loop accumulating space J1 comprises a rectangular cloth sheet, which is suspended at opposed ends thereof to form a curved face therebetween acting as a delimiting face. Opposed sides of this accumulating space are totally open. To describe its construction in greater details, as shown in FIG. 3, one end of the longitudinal cloth stocker sheet 41 is attached to the top of the side walls of the stocker box 42 on the side of the first loop accumulating space J1, while the other end thereof is terminated with a rod 43 longer than the width of the sheet. As opposed ends of this rod 43 acting as a fixing tool are hooked on hooks 44 provided on the bottom face of the housing of the printing unit PU, there is formed an accumulating space which is delimited only in the transporting direction of the recording medium 1 to be accumulated and in the downward direction and which is totally open on lateral sides normal to the transporting direction. And, as the boundary faces are formed of the cloth stocker 41, the first loop accumulating space J1 is very flexible (see FIG. 6A). Further, when the rod 43 is removed from the hooks 44 and then the stocker is placed on the floor face, there will be formed a first loop accumulating space J1 which is open additionally on one side in the transporting direction of the recording medium 1, thus allowing temporary storage of a recording medium 1 having a significant length (see FIG. 6B).

Incidentally, the attachment of one end of the longitudinal cloth stocker sheet 41 to the stocker box 42 may be made at any desired height position of the side walls of the stocker box 42 on the side of the first loop accumulating space J1. In any case, a partition wall partitioning between the first loop accumulating space J1 and the second loop accumulating space J2 will be formed of the side wall of the stocker boxy 42 or a part of the cloth stocker sheet 41 or of both of these.

As shown in FIG. 5, the pinching transport roller set 31 includes a turn roller 31*a* rotatably driven by a stepping motor M1 and three assist rollers 31*b* supported in pressed contact with the peripheral face of the turn roller 31*a*. The turn roller 31*a* has an outer diameter of about 60 mm, whereas the assist rollers 31*b* each has an outer diameter of about 30 mm. The three assist rollers 31*b* are free rollers spaced apart from each other along the peripheral face of the turn roller 31*a*. And, these assist rollers provide a function for pressing the recording medium 1 against the peripheral face of the turn roller 31*a* in such a way that the recording medium 1 may be wound about the peripheral face of the turn roller 31*a* with a winding angle of about 125 degrees. With this pressing action, the recording medium 1 may be transported reliably by the turn roller 31*a* and at the same time the upwardly convex curling tendency if present in the recording medium 1 may be eliminated or at least reduced. That is to say, the pinching transport roller set 31 acts also as a "curl correcting" roller for alleviating curling tendency of the recording medium 1. As this curl correcting function will vary depending on the outer diameter of the turn roller 31*a* and the arrangement of the assist rollers 31*b* relative to the turn roller 31*a*, these factors may be appropriately determined according to the curling tendency of the recording medium 1. Incidentally, through not shown in FIG. 5, between the adjacent assist rollers 31*b*, there is provided a guide member for preventing inadvertent withdrawal of the leading end of the recording medium 1 from between the assist roller and the turn roller 31*b* due to the rigidity and curling tendency of the recording medium 1 per se.

Further, the transport speed of the recording medium 1 by the pinching transport roller set 31may be switchable among a first speed (low speed: 80 mm/min.) which is much lower than the minimal transport speed by the first transporting mechanism 6A, a second speed (intermediate speed: 300 mm/min.) which is slightly higher than the regular transport speed of the first transporting mechanism 6A and a third speed (high speed: 18,000 mm/min.) which is much higher than the transport speed of the first transporting mechanism 6A.

The first guide mechanism 35 includes the first stationary guide plate 35*a* disposed in opposition to the surface of the recording medium 1 discharged from the printing unit PU, i.e. extending substantially along the transporting line which extends straight between the exit of the printing unit PU and the pinching transport roller set 31 and the first movable guide plate 35*b* pivotable about an axis X1 extending parallel with the width of the recording medium 1. By drive from a motor M2, the first movable guide plate 35*b* is pivotable between a substantially vertical closed position (shown by a solid line in FIG. 5) forming a guide space relative to the first stationary guide plate 35*a*, the space having a wedge-like cross section whose width is progressively narrowed toward the downstream side in the transporting direction and an opened position (shown by a dashed line in FIG. 5) inclined toward the bottom face of the printing unit PU so as to open up one side of the recording medium 1 as a transportation-free area. At its closed position, the first movable guide plate 35*b* cooperates with the first stationary guide plate 35*a* to guide the leading end of the recording medium 1 to the pinching transport roller set 31, more particularly, to a nipping position between the turn roller 31 and the assist roller 31*b* located most upstream in the transporting direction. In order to convert the rotational drive from the motor M2 into the pivotal movement of the first movable guide plate 35*b*, a first sector 35*c* is fixed to a pivot shaft of the first movable guide plate 35*b* and also an arc-shaped rack gear formed in the peripheral face of the first sector 35*c* is meshed with a pinion secured to the drive shaft of the motor M2. Incidentally, as the first guide mechanism 35 forms a substantially vertical transporting line, a pivotal type introducing guide 34 is provided for assisting in smooth transfer of the recording medium 1 therefrom to the first transporting mechanism 6A which forms a horizontal transporting line.

Similarly, the second guide mechanism 36 is disposed in opposition to the surface of the recording medium 1. And, the second guide mechanism 36 includes the second stationary guide plate 36*a* extending substantially along the transporting line which extends straight between the pinching transport roller set 31 and the entrance of the heating fixing unit HU and the second movable guide plate 36*b* pivotable about an axis X2 extending parallel with the width of the recording medium 1. By drive from a motor M3, the second movable guide plate 36*b* is pivotable between a substantially vertical closed position forming a slit for allowing passage of the recording medium 1 relative to the second stationary guide plate 36*a* and an opened position inclined toward the heating fixing unit HU so as to open up one side (lower side) of the recording medium 1 as a transportation-free area. At its closed position, the second movable guide plate 36*b* cooperates with the second stationary guide plate 36*a* to guide the leading end of the recording medium 1 to the feed roller set 32 from the pinching transport roller set 31, more particularly, from a nipping position between the turn roller 31 and the assist roller 31*b* located most downstream in the transporting direction. In order to convert the rotational drive from the motor M3 into the pivotal movement of the second movable guide plate 36*b*, a second sector 36*c* is fixed to a pivot shaft of the second movable guide plate 36*b* and also an arc-shaped rack gear formed in the peripheral face of the second sector 36*c* is meshed with a pinion secured to the drive shaft of the motor M3.

Incidentally, in general, the feed roller set 32 is driven by a stepping motor M4 at a transport speed synchronized with the transport speed of a heating transporting mechanism 54 of the heating fixing unit HU.

According to the intermediate transporting mechanism 30 having the above-described construction, when the recording medium 1 is fed from the last discharge roller of the first transporting mechanism 6A further into the intermediate transporting mechanism 30 with the leading end of the recording medium being pinched by the pinching transport roller set 31 with the first movable guide plate 35*b* being switched over to the second posture, this recording medium 1 will project in the form of a loop into the first storage section 30A. Further, when the recording medium 1 is further transported by the pinching transport roller set 31 with the leading end of the recording medium 1 being pinched by the feed roller set 32 and with the second movable guide plate 36*b* being switched over to the second posture, this recording medium 1 will project in the form of a loop into the second storage section 30B.

In order to transport the recording medium 1 from the printing unit PU to the heating fixing unit HU while forming loops thereof in the first storage section 30A and the second storage section 30B respectively, it is necessary to control the respective driving components of the intermediate transporting mechanism 30 with appropriate timings. To this end, the intermediate transporting mechanism 30 includes sensors comprising optical elements, limit switches or the like. These sensors include, for instance, a first sensor Si for detecting presence of the recording medium 1 slightly upstream of the turn roller 31*a* (the sensor is ON for presence and OFF for absence), a second sensor S2 for detecting presence of the recording medium 1 between the transportation-wise most upstream assist roller 31*b* and the next assist roller 31*b* (the sensor is ON for presence and OFF for absence), a third sensor S3 for detecting presence of the recording medium 1 transportation-wise most downstream of the intermediate transporting mechanism 30 (the sensor is ON for presence and OFF for absence), a fourth sensor S4 for detecting the closed position of the first movable guide plate 35*b* (the sensor is ON for the closed position and OFF otherwise), a fifth sensor S5 for detecting the opened position of the first movable guide plate 35*b* (the sensor is ON for the opened position and OFF otherwise), a sixth sensor S6 for detecting the closed position of the second movable guide plate 36*b* (the sensor is ON for the closed position and OFF otherwise), a seventh sensor S7 for detecting the opened position of the second movable guide plate 36*b* (the sensor is ON for the opened position and OFF otherwise), an eighth sensor S3 for detecting presence of the recording medium 1 transportation-wise most upstream of the intermediate transporting mechanism 30 (the sensor is ON for presence and OFF for absence), sand a ninth sensor S9 for detecting slackness or its amount in the recording medium 1 which has advanced into the first storage section 30A (the sensor is ON for presence of slackness over a threshold value and OFF for slackness below the threshold value). Incidentally, the ninth sensor S9 as the slackness detecting sensor is constructed as an optical element or a limit switch for detecting a transportation-wise vertical bulged portion in the recording medium 1 which is formed due to slackness present in the recording medium.

Figure 3:
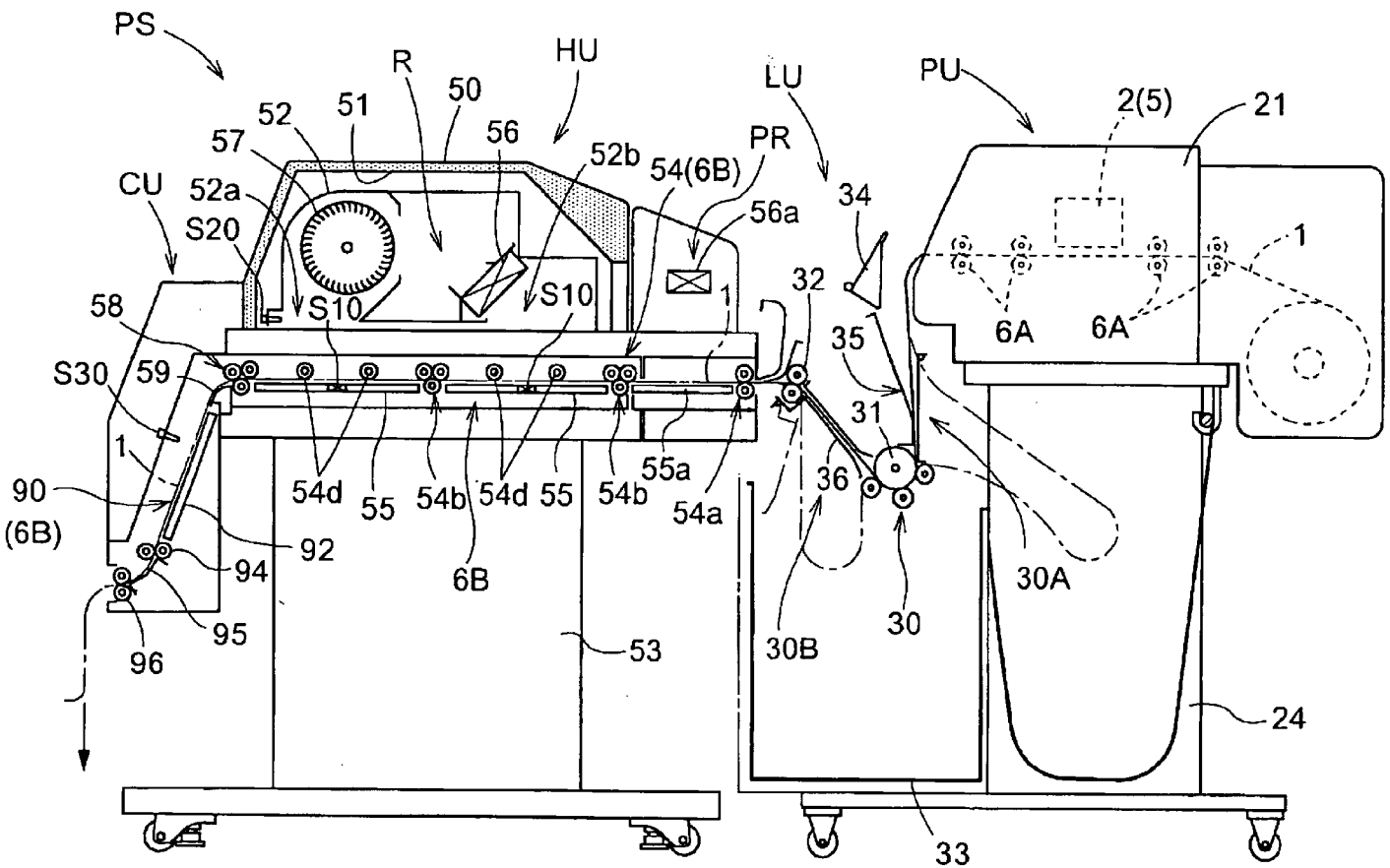
FIG. 3 is a schematic section showing a construction of a printing station of the image forming apparatus.
Figure 7:
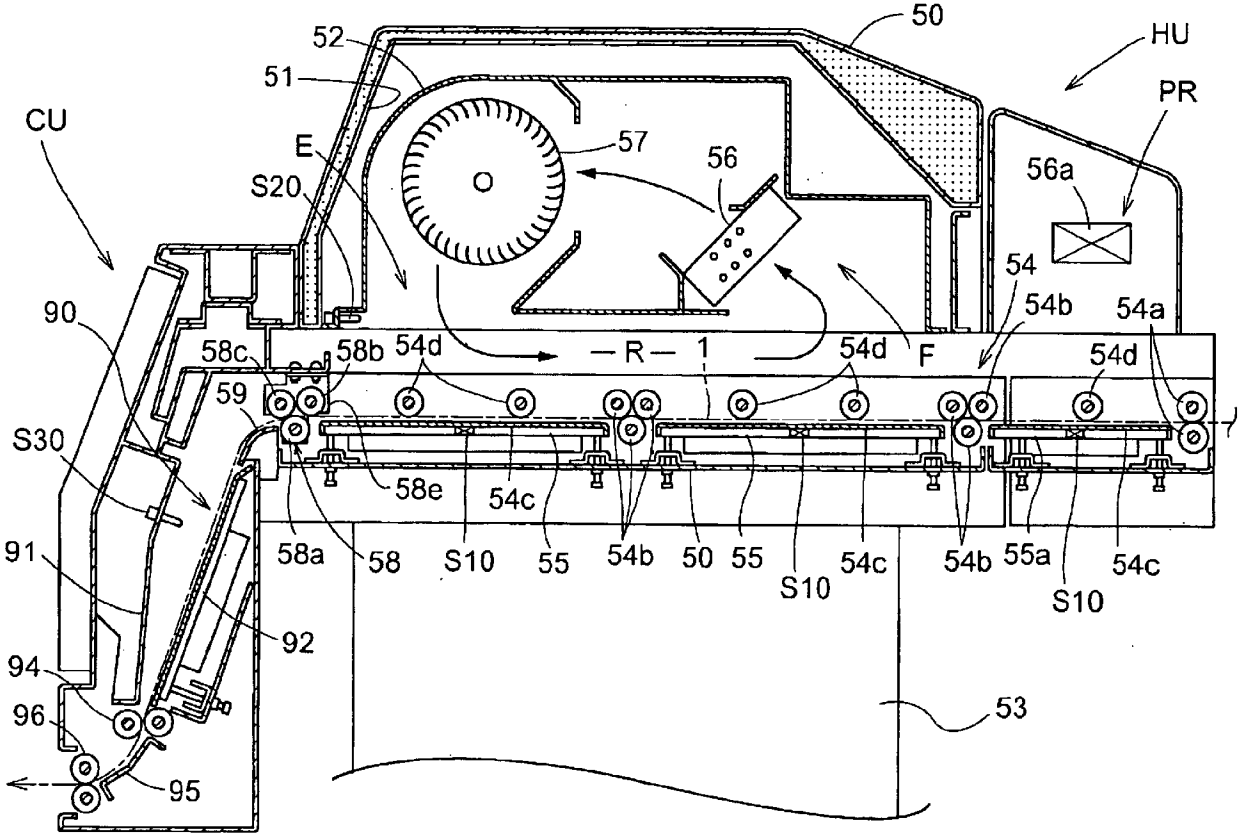
FIG. 7 is a schematic section showing constructions of a heating fixing unit and a slow cooling subunit.

The heating unit HU shown schematically in FIG. 3 and also shown in details in FIG. 7 includes the preliminary heating subunit PR, the main heating subunit R and the slow cooling subunit CU. The main heating subunit R includes, within a main casing 50 thereof, a heating case 51 made of insulating material for heating the recording medium 1, a blower case 52 also made of insulating material and disposed above the heating case 51 for supplying hot air to this heating case 51, and a support leg 53 for supporting the main casing 50. The preliminary heating subunit PR is disposed adjacent the entrance of the main heating subunit R, and the slow cooling subunit CU is disposed adjacent the exit of the main heating subunit R. In the preliminary heating subunit PR and the main heating subunit R, the heating transporting mechanism 54 for transporting the recording medium 1 is provided as a part of the second transporting mechanism 6B constituting the sheet transporting mechanism 6. This heating transporting mechanism 54 includes a pair of press type introduction rollers 54a provided adjacent the entrance of the heating fixing unit HU, i.e. in the preliminary heating subunit PR, a transport roller mechanism 54*b* for transporting the recording medium 1 by placing two rollers in contact with the front surface of the recording medium 1 and placing one roller in contact with the back surface of the medium 1 inside the main heating subunit R, a single guide member 54*c* disposed within the preliminary heating subunit PR for coming into contact with the bottom face of the recording medium 1 for transferring heat to the medium 1, a plurality of upper-face contact rollers 54*d* disposed upwardly of the guide member 54*c* and adapted for coming into contact with the upper surface of the recording medium 1 for applying a transporting force thereto, a press roller mechanism 58 disposed adjacent the exit of the main heating subunit R, and a curved transporting section 59 provided immediately transportation-wise downwardly of the press roller mechanism 58.

Figure 8:
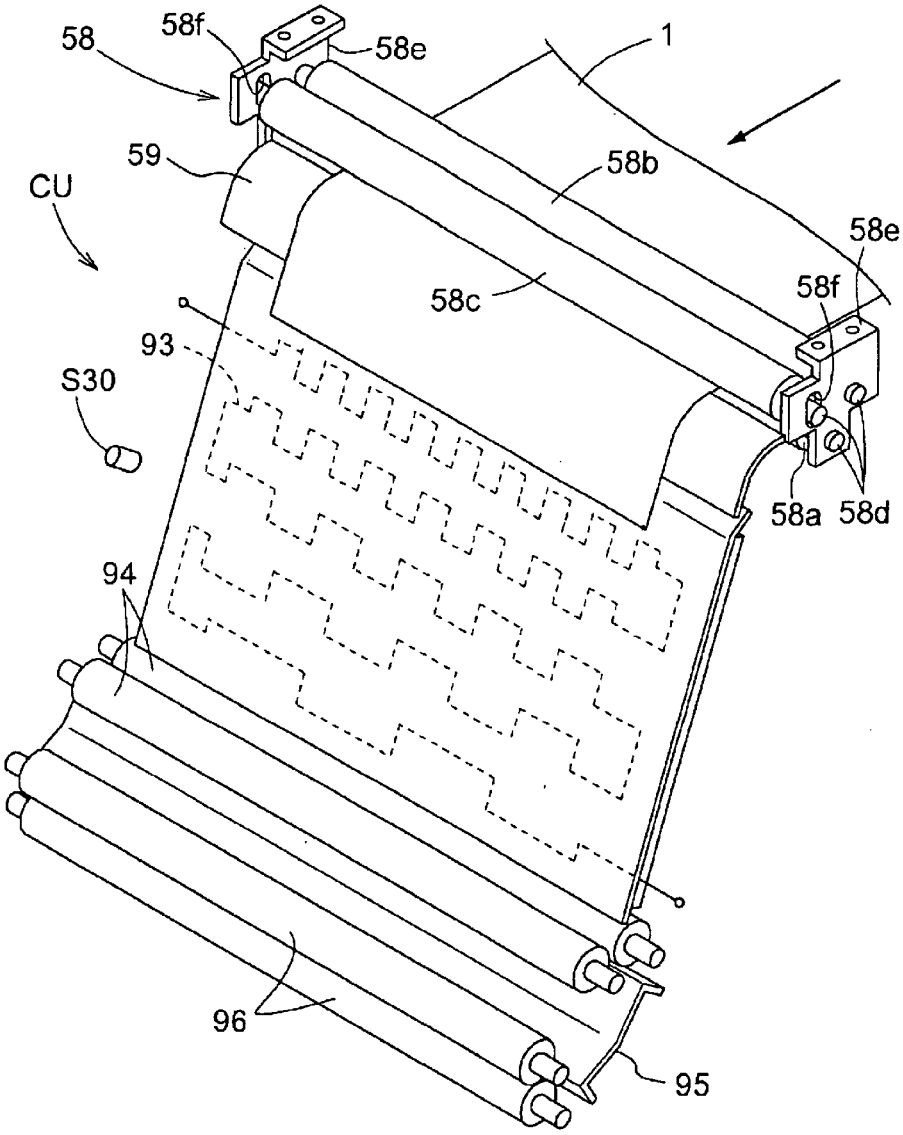
FIG. 8 is an enlarged schematic section showing a construction of a press roller mechanism.
Figure 9:
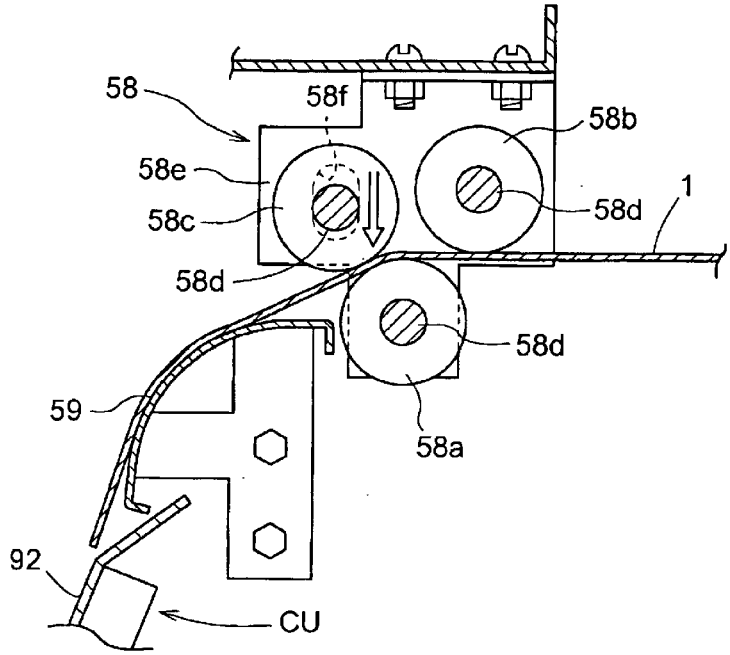
FIG. 9 is a perspective view showing a layout of an electric wire provided in a slow cooling guide member.

The press roller mechanism 58, as shown in FIG. 8 and FIG. 9, includes a first roller 58*a* for coming into contact with the back surface of the recording medium 1, a second roller 58*b* disposed transportation-wise upstream of the first roller 58*a* and adapted for coming into contact with the front surface of the recording medium 1, a third roller 58*c* disposed transportation-wise downstream of the first roller 58*a* and adapted for coming into contact with the front surface of the recording medium 1 and a bracket 58*e* for rotatably supporting roller shafts 58*d* of these rollers. The roller shaft 58*d* of the third roller 58*c* is inserted into a vertical guide hole 58*f* defined in the bracket 58*e*, so that the third roller 58*c* presses, by its own weight, the recording medium 1 between this third roller and the first roller 58*a*. Each of these rollers of the press roller mechanism 58 has a length longer than the maximum width of the recording medium 1 and the roller comprises a metal drum having laminated foamed resin on its surface. And, the weight of the third roller 58*c* is set so that when the roller presses the recording medium 1 therebetween with the first roller 58*a*, an ironing effect is generated for smoothing out wrinkles or the like which may have developed in the recording medium 1 during the heating fixing process. Although this weight will be determined through experiment or experimentally according to the length of the roller, any adjustment in this weight will be effected by means of a weight provided as an accessory. Needless to say, it is also possible to provide, by means of a spring or the like, the third roller 58*c* with an urging force toward the recording medium 1. As may be apparent from FIG. 9, the axis of the third roller 58*c* is offset to the downstream side from the axis of the first roller 58*a* relative to the transporting direction, so that the recording medium 1 will be slightly curved at this areas, thereby to enhance the ironing effect to be applied thereto.

Incidentally, all of the rollers constituting the heating transporting mechanism 54 are driven directly or indirectly via an unillustrated transmission belt. In this, although the third roller 58*c* has its roller shaft 58*d* movable to and away from the recording medium 1, this third roller 58*c* may be driven by means of a transmission mechanism having a tension adjusting pulley or the like which per se is well-known.

Further, the curved transporting section 59 comprises a guide body having a guide face for guiding the recording medium 1 such that its face bearing an image may be oriented to the outside. Hence, when the recording medium 1 is moved while contacting the face of such guide body 59, there is generated a tension on the front surface of the medium, which force serves to smooth out fine surface wrinkles therein.

On the bottom face of the guide member 54*c* disposed downwardly of the upper-surface contacting roller 54*d*, there are provided a main heating sheet heater 55, a preliminary heating sheet heater 55*a* for heating this guide member 54*c* and a fixing temperature sensor 41 disposed at the center of this sheet heater 55 for measuring a temperature of the guide member 54*c*. If necessary, the guide body constituting the curved transporting section 59 too may include a sheet heater and a temperature sensor for enabling a feedback control.

Inside the blower case 52, there are provided an electric heater 56 in the form of a plurality of rods and a crossflow fan 57 for driving fan blades about an axis extending parallel with the width of the recording medium 1 for feeding hot air. This blower case 52 defines, in its bottom face, an outlet 52*a* located immediately below the crossflow fan 57 for discharging hot air and an inlet 52*b* located upstream on the transporting passage for the recording medium 1 by the heating transporting mechanism 54. Adjacent the aperture of the outlet 52*a*, there is provided an air sensor S20 in correspondence with the crossflow fan 57.

The preliminary heating subunit PR too includes an electric heater 56*a*, but not any fan. Needless to say, if needed, the preliminary heating subunit PR too may include a fan.

When the recording medium 1 is heated, in the preliminary heating subunit PR, its inside temperature is maintained at a predetermined value by means of the electric heater 56*a*. Whereas, in the main heating subunit R, the electric heater 56 and the crossflow fan 57 are driven, thereby to feed the air heated within the blower case 52 through the outlet 52*a* to a position transportation-wise downstream of the recording medium 1 inside the heating case 51 for a feeding width greater than the entire width of the recording medium 1, so that this hot air is caused to flow in the heating space toward the transportation-wise upstream side along the transporting passage of the recording medium 1. Then, the air is drawn into the blower case 52 through the inlet 52*b* at a position transportation-wise upstream of the recording medium 1 to be heated by the electric heater 56. After this, the heated air is supplied to the crossflow fan 57. In this way, the heated air is circulated.

According to a typical heating temperature control scheme, power is supplied to the respective electric heaters 56, 56*a* and the respective sheet heaters 55, 55*a* so that the fixing temperature sensor S10 may sense temperature of about 180° C., the fixing temperature sensor S10 inside the preliminary heating subunit PR may sense temperature of about 100° C., the transportation-wise upstream fixing temperature sensor S10 in the main heating subunit R may sense temperature of about 130° C. and the transportation-wise downstream fixing temperature sensor S10 of the same may sense temperature of about 180° C., respectively.

The slow cooling subunit CU, as shown in FIG. 7 and FIG. 8, includes a slow cooling guide member 92 acting as a transportation guide body for the recording medium 1, slow cooling intermediate transporting roller pair 94, and a turn guide 95, discharging roller pair 96 and these components together constitute a slow cooling transporting mechanism 90. This slow cooling transporting mechanism 90 is disposed inside a slow cooling space which is substantially closed by a slow cooling case 91. The second transporting mechanism 6B for transporting the recording medium 1 inside the heating fixing unit HU comprise the heating transporting mechanism 54 and the slow cooling transporting mechanism 90.

The slow cooling guide member 92 extends with a width exceeding the maximum width of the recording medium 1 so as to form an inclined guide face for coming into fact contact with the recording medium 1. The inclination of the inclined face is determined within a range between 20 degrees and 60 degrees relative to the vertical axis. To the rear face of the slow cooling guide member 92, there is mounted an electric wire 93 acting as a heater capable of transmitting heat to this slow cooling guide member 92.

The heat to be transmitted from this electric wire 93 to the slow cooling guide member 92 is adjusted such that the temperature at the recording medium entrance of the slow cooling guide member 92 may be substantially equal to the temperature at the exit of the main heating subunit and also that the temperature at the recording medium exit of the slow cooling guide member 92 may be substantially equal to the room temperature and also the temperature gradient therebetween may form as mild as possible curve. With this, occurrence of deformation such as wrinkles in recording medium 1 during its cooling process may be effectively restricted.

Figure 10:
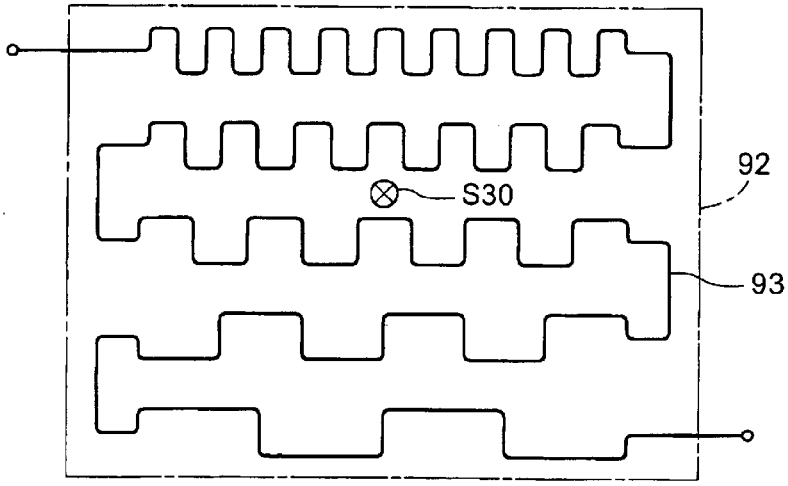
FIG. 10 is a perspective view showing constructions of the press roller mechanism and the slow cooling subunit.
Figure 11:
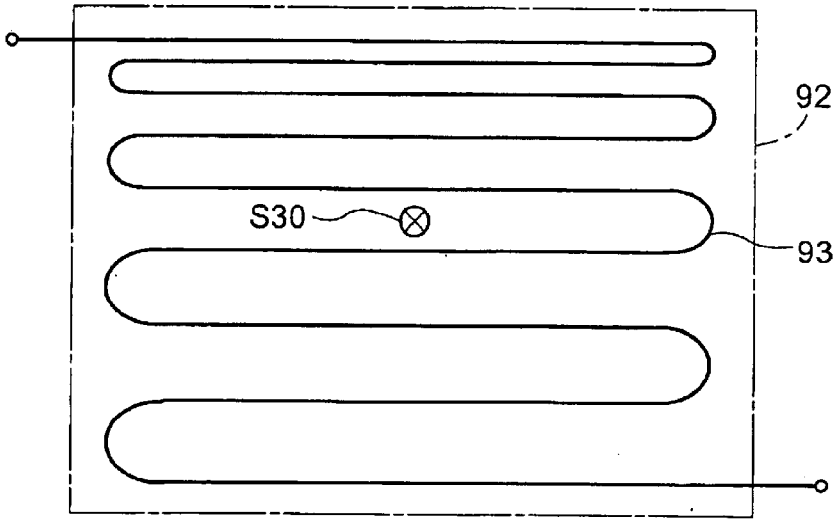
FIG. 11 is a schematic view showing a further layout of the electric wire provided in the slow cooling guide member.

To this end, as shown in FIG. 10, the electric wire 93 is arranged in such a manner as to provide a relatively high disposing density on the transportation-wise upstream side relative to the slow cooling guide member 92 and a relatively low disposing density on the transportation-wise downstream side. In order to obtain a temperature gradient having as mild as possible curve, as shown in FIG. 11, a meander layout having continuously variable disposing pitch may be employed also. In the embodiment modes of FIG. 10 and FIG. 11, the electric wire 93 comprises a single wire. Hence, by varying the power to be supplied to the electric wire 93, the temperature in the slow cooling guide member 92 will be raised or lowered correspondingly.

As a predetermined electric current is supplied to this electric wire 93, in the slow cooling guide member 92, there is developed such temperature gradient described above effective for restricting occurrence of wrinkles, e.g. temperature gradient from about 180° C. to 20° C. This control of the power to be supplied to the electric wire 93 is effected with accuracy by means of the controller 7, using, as feedback, the detection signal from a slow cooling temperature sensor S30 disposed directly at the intermediate area of the slow cooling guide member 92 or disposed upwardly of the guide face.

Figure 12:
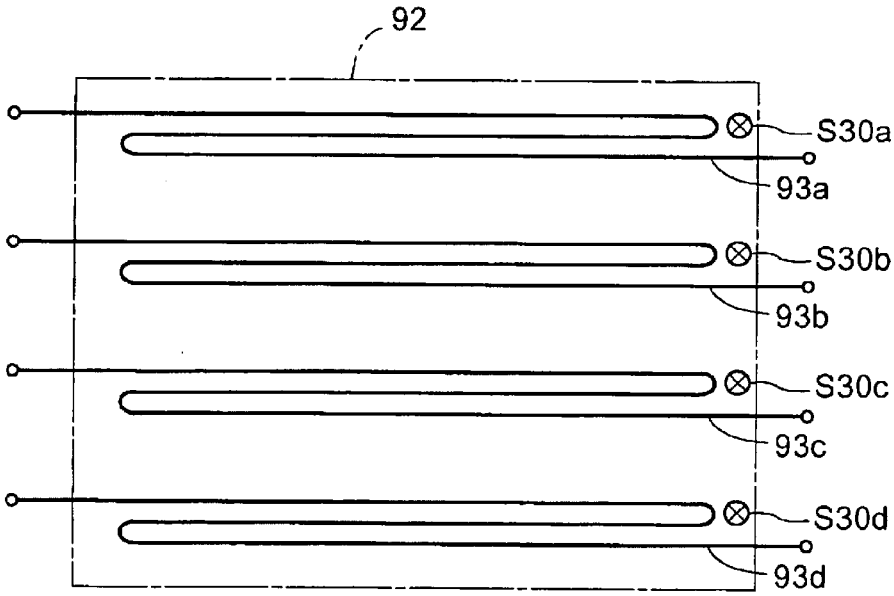
FIG. 12 is a schematic view showing a layout of the electric wire provided in the slow cooling guide member according to a further embodiment.

As an embodiment allowing desired adjustment of the temperature gradient in the slow cooling guide member 92 in the transporting direction, for instance, as shown in FIG. 12, the electric wire 93 may be divided into a first electric wire 93*a*, a second electric wire 93*b*, a third electric wire 93*c*, a fourth electric wire 93*d*, and so on, in the order from the area adjacent to the recording medium entrance to the area adjacent the recording medium exit, so as to allow independent control of the power to be supplied to the respective wires. In this case, at positions corresponding to these respective electric wires 93*a*, 93*b*, 93*c*, 93*d* . . . , a plurality of slow cooling temperature sensors S30*a*, S30*b*, S30*c*, S30*d* . . . will be provided, so that the respective electric wires may be feedback controlled whereby a desired temperature gradient may be developed in the slow cooling guide member 92 as a whole. This alternative construction will be particularly advantageous in such case where the fixing temperature greatly varies depending on the type of the recording medium 1 employed or the room temperature significantly varies from one season to another.

In order to receive the recording medium 1 discharged from the slow cooling unit CU, as shown in FIGS. 2 and 3, there is provided a stocker ST. This stocker ST comprises a box-like member having a width greater than the maximum width of the recording medium 1 which can be processed. And, its inside has a lining of sheet interwoven with carbon fibers having conductivity for eliminating static electrical charge. Further, as the recording medium 1 discharged from the slow cooling unit CU has a certain amount of curling tendency, then, by utilizing this curling tendency, the medium will be wound without a core inside the stocker ST for storage therein. In the recoding medium 1 wound and stored within the stocker ST, the ink (pigment) forming its printed image are already fixed within the fixing layer 11. Then, by removing the surface layer 12, a finished printed product 100 having a clearly color-developed image may be obtained.

Incidentally, the guide member 41C of the preliminary heating subunit PR too may employ such heater construction as employed in this slow cooling guide member 92 adapted for obtaining a desired temperature gradient.

The controller 7 functioning as a control unit for the image forming apparatus having the above-described construction includes a first controller 7A provided in an operator's station OS and a second controller 7B provided in the printing station PS, with the two controllers 7A, 7B being connected to each other via communication cable for allowing data exchange therebetween, so that the two controllers 7A, 7B may function just like a single controller.

As shown in FIG. 2, the operator's station OS includes a general-purpose computer 80 acting also as the first controller 7A, a monitor 81, a keyboard 82, a mouse 83, a film scanner 85 for effecting photoelectric conversion of a photographic image of a developed silver-salt type photographic film F into color image data, and an image reading unit 84 (in this case, this unit is incorporated within the computer 80) for reading or obtaining color image data from a data storage medium (CD, CD-R, MO, or any kind of semiconductor memory device such as Compact-Flash or SmartMedia as well as any communication media comprising a data communication line). In the case of this image forming apparatus, the image data obtained by the film scanner 85 or the image reading unit 84 and then transmitted to the first controller 7A will be subjected to various necessary data processing operations and then, the processed image data will be transmitted as source print data to the second controller 7B, so that a printed image will be formed on the recording medium 1 at the printing station PS and heated and fixed thereon.

As described above, the controller 7 includes the first controller 7A and the second controller 7B each having as a major component thereof a microcomputer system having CPU, ROM, RAM, I/O interface circuit etc. As shown in FIG. 13, to the first controller 7A, via the I/O interface circuit, there are connected such peripheral devices as the image reading unit 84, the film scanner 85, etc. To the second controller 7B, via its I/O interface circuit, there are connected the peripheral devices incorporated in the printing station PS including the inkjet print head 2, the head feeding mechanism 3, the electric heaters 56, 56*a*, the crossflow fan 57, the recording medium transporting mechanism etc. Further, a recording medium type detecting sensor S40 is provided for detecting an ID code provided on the roll sheet cartridge or on a shaft member supporting the recording medium 1 around it in the rolled state and this sensor transmits its type detection signal to the controller 7, so that the controller 7 may recognize the type of the charged recording material 1 based on this detection signal. The first controller 7A and the second controller 7B are capable of data transmission via respective communication modes thereof. For instance, the image data having been subjected to the image processing and adjustment processing at the first controller 7A will be converted into final print data, which will then be transmitted to the second controller 7B via the communication module 74*a*, 74*b* to be subsequently used for e.g. application of the sublimating ink to the recording medium 1.

The various functions provided by the controller 7 are realized by means of hardware and/or software. Referring here to only those functional elements having relevance to the present invention, the following sections are provided as typical examples; namely, an image data inputting section 71 for effecting pre-processing on the image data obtained by the image reading unit 84 or the film scanner 85 such as a format conversion or resolution conversion; an image processing section 72 for effecting image adjustments on the image data transmitted from the image data inputting section 71 such as a trimming or color adjustment; a print data generating section 73 for generating source print data for subsequent use by the print head 2 from the final image data by implementing a binarizing method such as an error diffusing method; a print controlling section 75 for driving the print head 2 in accordance with the transmitted print data for discharging ink droplets through the outlet and also for controlling intermittent feeding of the recording medium 1 in synchronism with the movement of the print head 2 along the main scanning direction within the printing unit PU; a transportation controlling section 76 for controlling the transportation of the recording medium 1 inside the heating fixing unit HU; a heating controlling section 77 for controlling the power supply to the sheet heaters 55, 55*a*, electric heaters 56, 56*a*, the crossflow fan 57 of the heating fixing unit HU as well as the electric wire 93 (93*a*, . . . ) as the heater for the slow cooling guide member 92; a storage controlling section 78 for controlling the respective driving components of the loop-forming unit LU; and a recording medium type identifying section 79 for obtaining type data of the charged recording medium 1 based on the ID code thereof read by the recording medium type detecting sensor S40. Incidentally, the storage cooling controlling section 78 can effect the control of the power supply to the electric wire 93 (93*a* . . . ), with taking into consideration, also if needed, such additional information concerning the recording medium type information obtained by the recording medium type identifying section 79 and the room temperature.

Next, there will be described a typical process for producing a final printed product by using the image forming apparatus having the above-described construction.

1. Printed Image Forming Stage

First, image data in the JPEG format read from the MO disc by means of the image reading unit 84 are transmitted as image source for this image forming apparatus to the image data inputting section 71. At this image data inputting section 71, the JPEG image data are mapped into 8-bit RGB color image data and then transmitted to the image processing section 72. Then, the image data are processed in accordance with the print size, trimming setting command, color adjustment command etc. inputted by the operator by operation of the keyboard 82 or the mouse 83. Upon completion of the predetermined image processing, the image data will be transmitted to the print data generating section 73. Incidentally, since the RGB color data have already been converted into the CMYK color image data at an appropriate stage after or before the other image processing, the color data transmitted to the print data generating section 73 are CMYK color image data. At this print data generating section 73, the CMYK color image data are converted into binary CMYK print data, which are then transmitted to the print controlling section 75. As described hereinbefore, the print controlling section 75 generates drive pulse signals for the print head 2 from the transmitted binary CMYK print data, whereby the drive elements of the print head 2 are controllably driven to form an image on the recording medium 1 with ink dots.

2. Recording Medium Storage Stage

Figure 14:
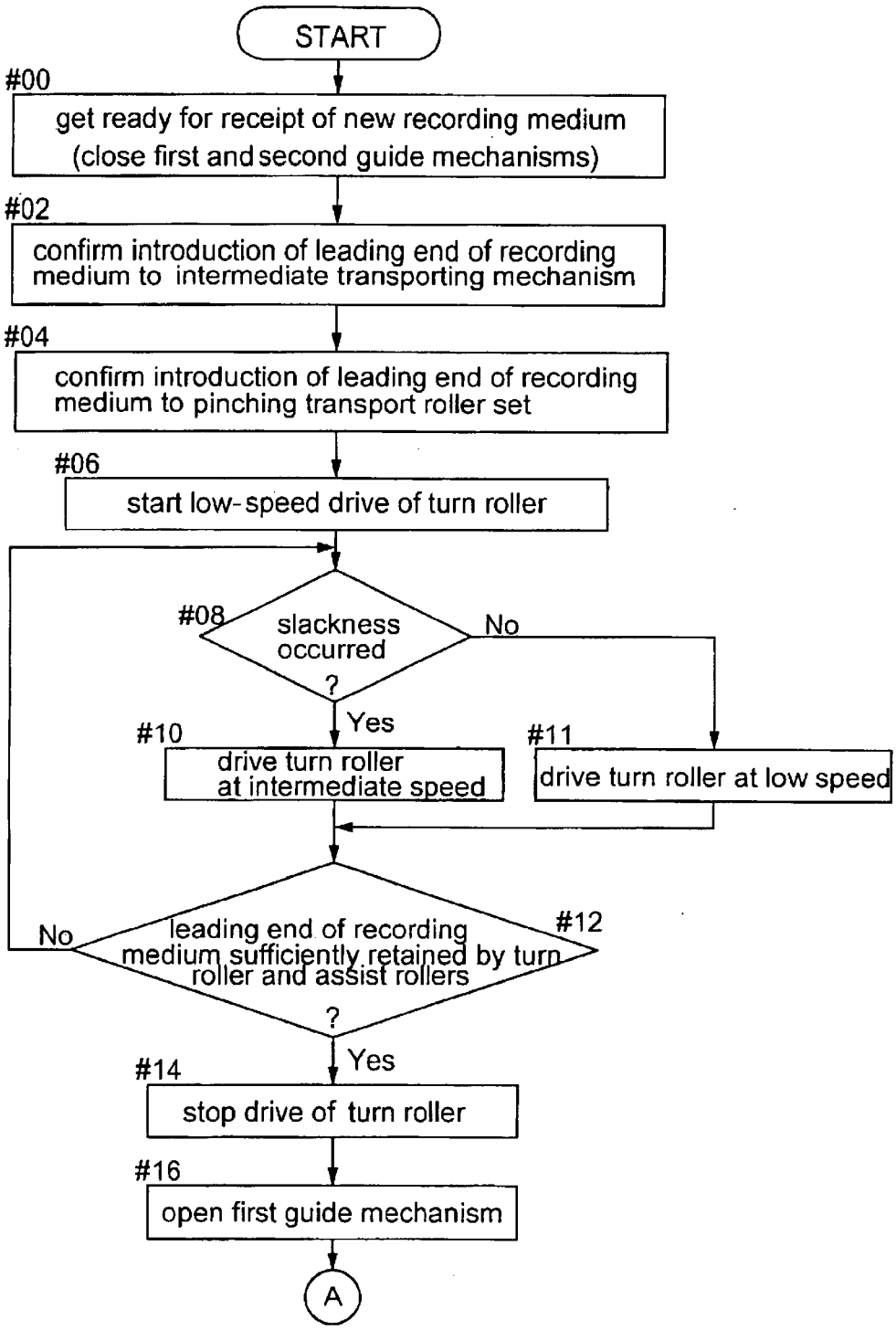
FIG. 14 is a flowchart illustrating an operation by an intermediate transporting mechanism for feeding a recording medium 1 sent from a printing unit PU to a heating fixing unit HU while forming a loop of the medium.
Figure 15:
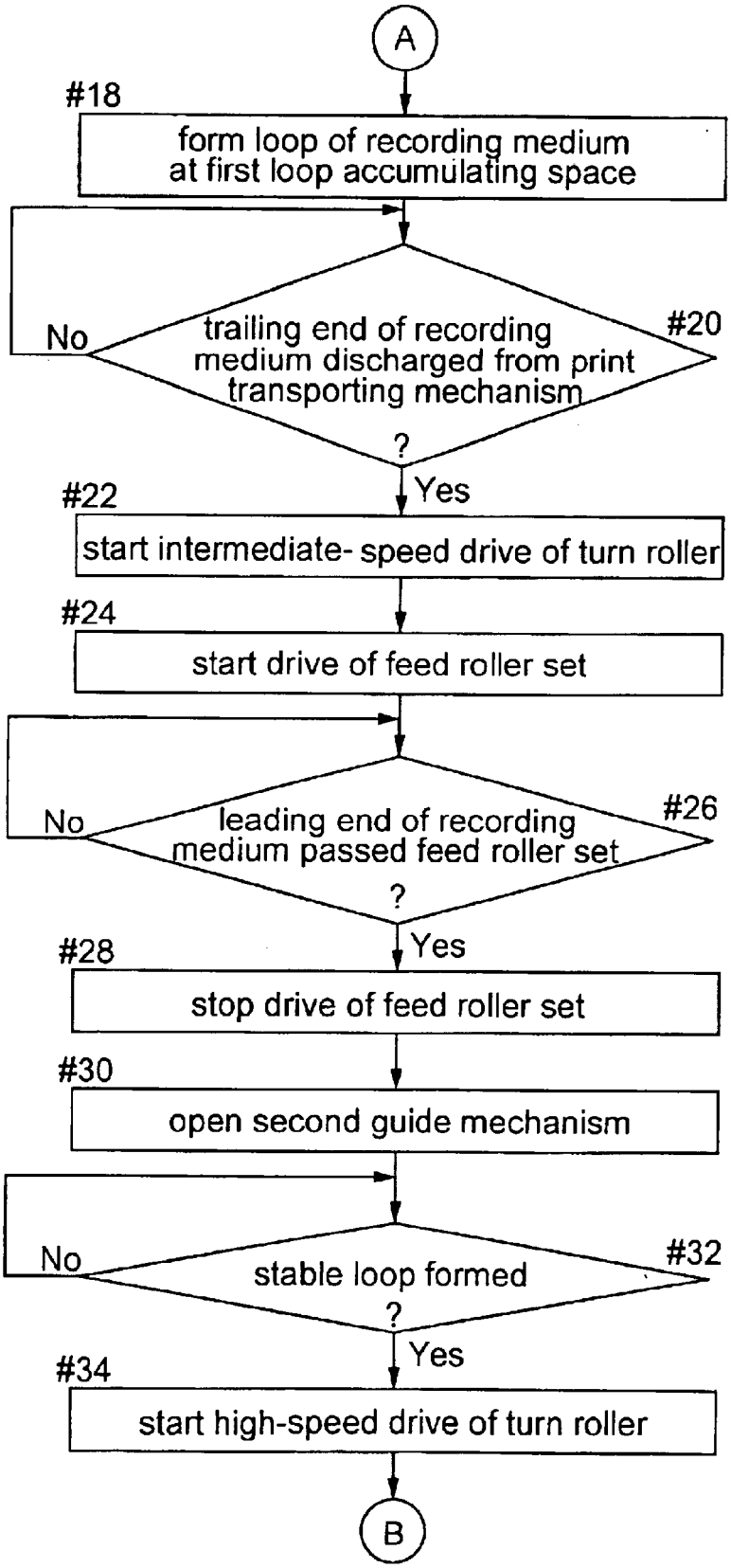
FIG. 15 is a flowchart illustrating a process subsequent to the process illustrated in the flowchart of FIG. 14.
Figure 16:
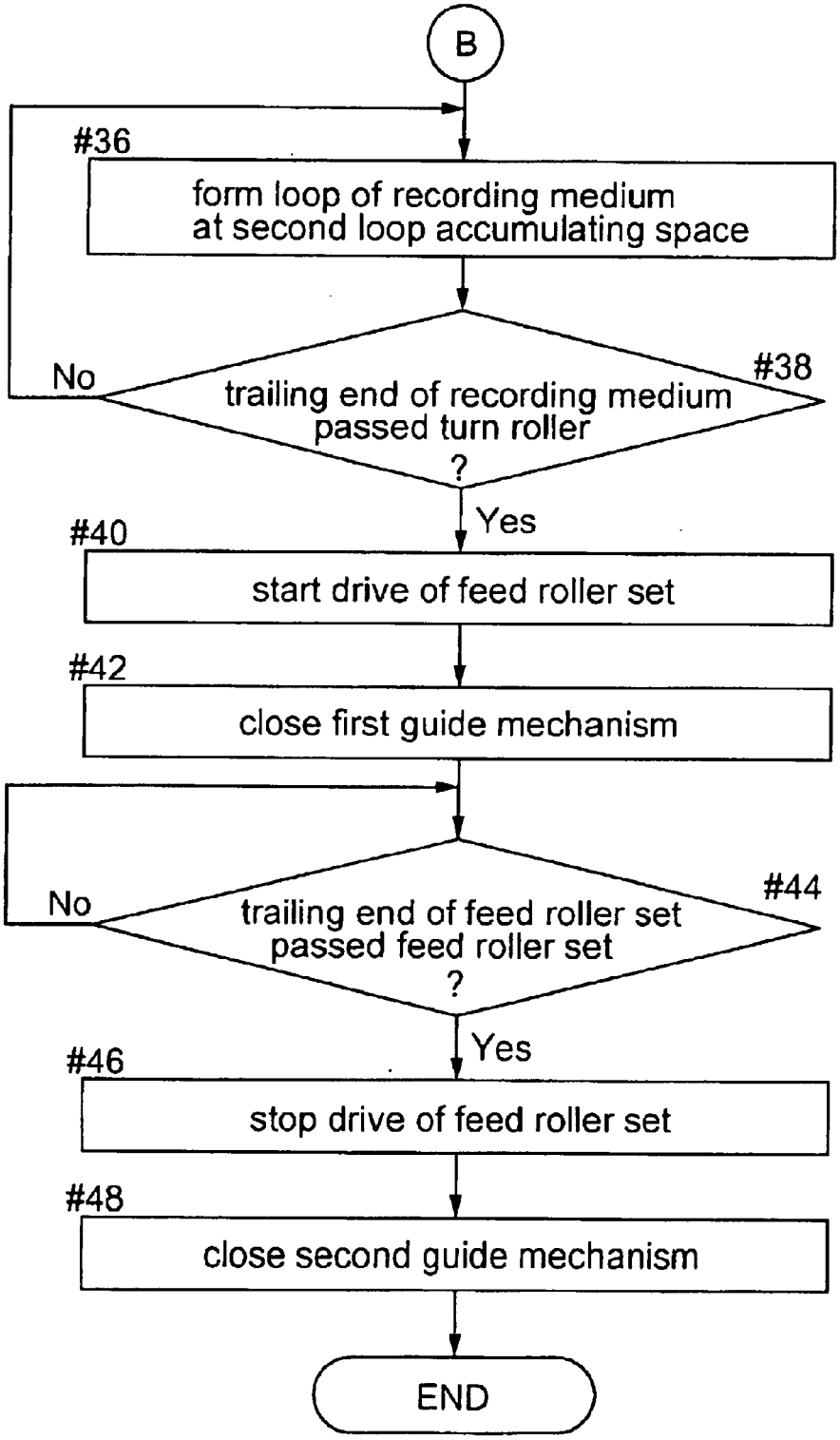
FIG. 16 is a flowchart illustrating a process subsequent to the process illustrated in the flowchart of FIG. 15.

Next, a mode of temporary storage or retention of the recording medium 1 by the loop-forming unit LU will be described with reference to FIGS. 14, 15 and 16.

First, the process waits for discharge of the recording medium 1 from the printing unit PU. In this wait or standby condition, the first movable guide plate 35*b* and the second movable guide plate 36*b* are maintained at the respective closed positions thereof These closed positions of the two movable guide plates 35*b*, 36*b* can be confirmed by the ON states of the fourth sensor S4 and the sixth sensor S6, respectively (#00). Then, the process confirms introduction of the leading end of the recording medium 1 from the first transporting mechanism 6A into the intermediate transporting mechanism 30 from change in the state of the eighth sensor S8 from the OFF state to the ON state (#02). Subsequent introduction of the leading end of the recording medium 1 into the pinching transport roller set 31 is confirmed based on lapse of a predetermined period, e.g. 5 seconds from OFF state to ON state change of the first sensor S1 (#04). When the leading end of the recording medium 1 has entered the pinching transport roller set 31, the motor M1 for the turn roller 31*a* is drive at the low speed, thereby to initiate the low-speed transportation (80 mm/min) of the recoding medium 1 by the turn roller 31*a* and the assist rollers 31*b* (#06).

During this low-speed transportation of the recording medium 1 by the pinching transport roller set 31 which is lower than the transport speed by the first transporting mechanism 6A, slackness begins to develop in the recording medium 1 in the first storage section 30A and the medium begins to bulge in the vertical direction relative to the transporting direction. When the amount of this slackness (bulging) has exceeded the predetermined threshold value, this is confirmed by OFF state to ON state change in the ninth sensor S9. In checking this slackness (#08), if the slackness amount is found to exceed the threshold value, the motor M1 for the turn roller 31*a* is switched over to the intermediate speed drive, thereby to initiate the intermediate-speed transportation (300 mm/min) of the recording medium 1 by the turn roller 31*a* and the assist rollers 31*b* (#10), so that the slackness is gradually reduced. On the other hand, if the slackness amount goes below the threshold value, the motor M1 for the turn roller 31*a* is switched over back to the low-speed drive, whereby the pinching transport of the recording medium 1 by the turn roller 31*a* and the assist rollers 31*b* is switched to the low-speed transportation (80 mm/min) (#11).

In this way, in the simultaneous transportation by the first transporting mechanism 6*a* and the pinching transport roller set 31, while the slackness in the recoding medium 1 (its floating from the transporting line) at the first storage section 30A which can adversely affect the print quality is minimized, the transport speed of the recording medium 1 by the pinching transport roller set 31 is switched to the low speed, thereby to prevent the load applied to the recording medium discharged from the printing unit PU from adversely affecting its print quality.

When the process confirms, based on the OFF state to ON state change in the second sensor S2, that the leading end of the recording medium 1 has reached a position where the medium can be sufficiently pinched between the turn roller 31*a* and the assist rollers 31*b* (#12), the motor M1 for the turn roller 31*a* is stopped, thereby to suspend the pinching transport of the recording medium 1 by the turn roller 31*a* and the assist rollers 31*b* (#14). At the same time, the motor M2 is driven to pivot the first movable guide plate 35*a* to its opened position (#16). The recording medium 1 introduced by the first transporting mechanism 6A with the first guide mechanism 35 being opened and the leading end of the recording medium 1 being retained by the pinching transport roller set 31 will be gradually accumulated, by the weight of its own, in the form of a loop at the first loop accumulating space J1 (#18).

With advance of the above-described loop accumulation of the recording medium 1 into the first loop accumulating space J1, the state of the eighth sensor S8 is eventually switched over from ON state to OFF state. With this, the process confirms arrival of the trailing end of the recording medium 1 to the intermediate transporting mechanism 30 (#20), when, in order to transfer the loop of the recording medium 1 accumulated at the first loop accumulating space J1 to the second loop accumulating space J2, the motor M1 for the turn roller 31*a* is driven at the intermediate speed, thereby to resume intermediate speed transportation (300 mm/min) of the recording medium 1 by the pinching transport roller set 31 (#22). At the same time, the motor M4 is driven to keep the drive roller and the assist rollers of the feed roller set 32 rotating (#24).

When the process confirms completion of passage of the leading end of the recording medium 1 through the feed roller set 32 based on ON state to OFF state change in the third sensor S3 (#26), the motor M4 is stopped, thereby to retain the leading end of the recording medium 1 by the feed roller set 32 (#28). At the same time, the motor M3 is driven to pivot the second movable guide plate 36*b* to its open position (#30). The recording medium 1 fed by the pinching transport roller set 31 which is continuously driven at the intermediate speed with the second guide mechanism 36 being opened and the leading end of the recording medium 1 being retained by the feed roller set 32 will begin to form a loop. As the loop accumulation of the recording medium 1 by the pinching transport roller set 31 being driven at the intermediate speed is continued for 10 to 20 seconds, whereby a stable loop is formed (#32). Then, the motor M1 for the turn roller 31*a* is driven at the high speed, thereby to effect high-speed transportation (18,000 mm/min) of the recording medium 1 by the pinching transport roller set 31 (#34). With this, the loop of the recording medium 1 accumulated at the first loop accumulating space J1 will be transferred rapidly into a loop at the second loop accumulating space J2 (#36).

After confirming arrival of the trailing end of the recording medium 1 to the pinching transport roller set 31 based on ON state to OFF state change in the second sensor S2, the process waits for lapse of about 5 seconds and confirms or assumes that the trailing end of the recording medium 1 has passed through the pinching transport roller set 31 (#38). Then, the process resumes driving of the feed roller set 32, thereby to begin to feed the recording medium 1 accumulated in the form of loop at the second loop accumulating space J2 into the heating fixing unit HU (#40).

In this, the recording medium 1 will be transported by both the heating transporting mechanism 54 and the feed roller set 32. In the course of this, a transport speed difference may be developed between the heating transporting mechanism 54 and the feed roller set 32 although these are set at a same transport speed, which difference applies a slight tension to the recording medium 1. This, however, will not cause any critical problem, since the recording medium 1 is exposed only to the thermal energy in the heating fixing unit HU'.

In order to be ready for receipt of a next recording medium 1 to be discharged from the printing unit PU, the process drives the motor M2 to pivot the first movable guide plate 35*b* to its closed position (#42).

Upon confirmation of completion of passage of the trailing end of the recording medium 1 through the feed roller set 32 based on ON state to OFF state change in the third sensor S3 (#44), the feed roller set 32 is stopped (#46) and the second movable guide plate 36*b* is pivoted to its closed position (#48).

In the case of the above-described process for transporting the recording medium 1 from the printing unit PU to the heating fixing unit HU while forming a loop of the medium, the recording medium 1 can be accommodated sufficiently within the first loop accumulating space J1 delimited by the cloth stocker sheet 4 to which the opposed ends of the recording medium 1 are hooked. However, if such first loop accumulating space J1 cannot accommodate the entire recording medium 1, the rod 43 formed at one end of the cloth stocker sheet 4 will be removed from the hook 44 and then placed on the floor surface, thereby to form a modified first loop accumulating space J1 having one side thereof in the transporting direction of the recording medium 1 completely open. Next, the process of loop forming transportation of the recording medium 1 will be described, regarding only some portions thereof different from the foregoing process.

Figure 17:
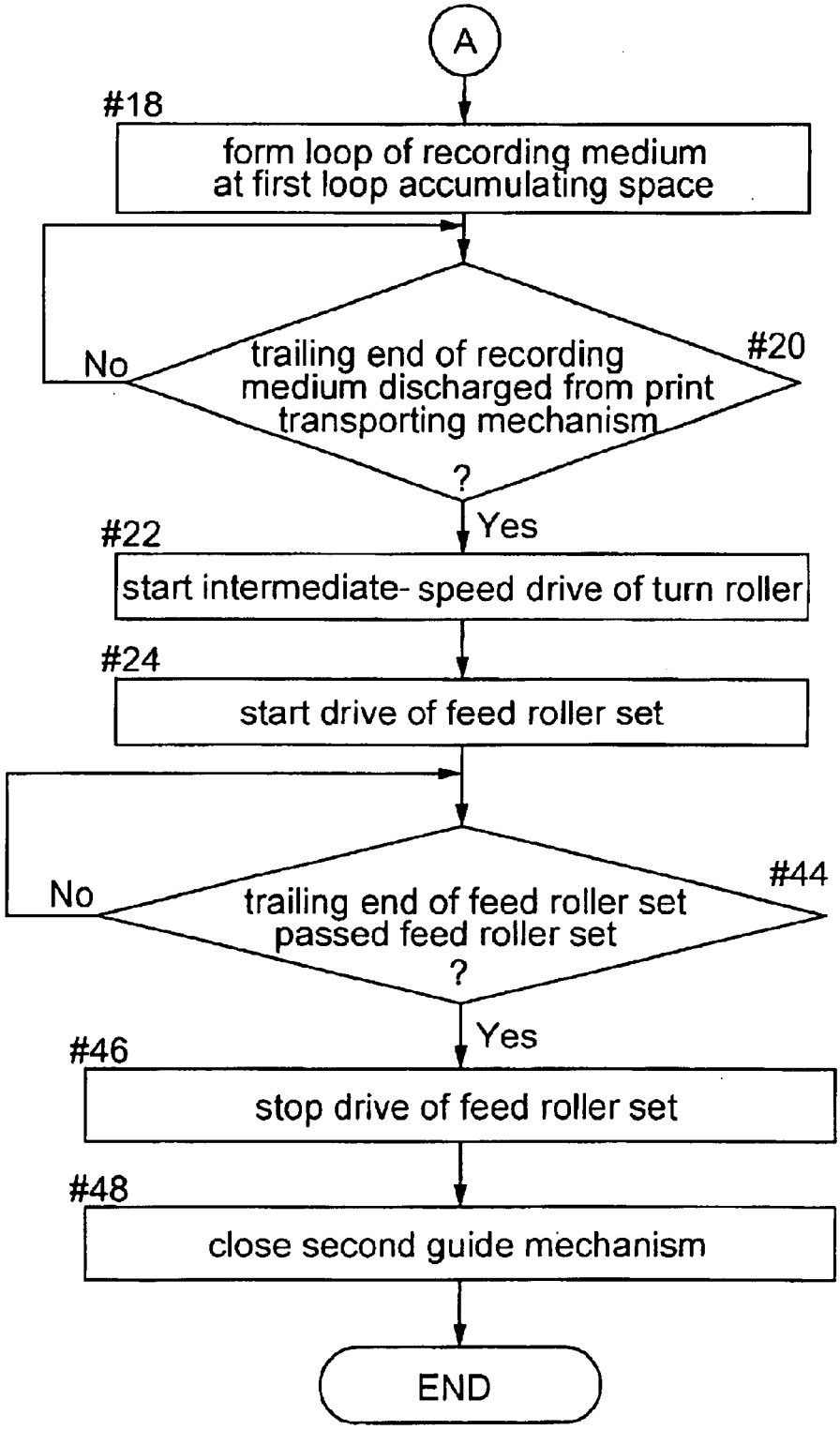
FIG. 17 is a flowchart illustrating an operation by the intermediate transporting mechanism in a different use.

According to one example, as shown by the flowchart of FIG. 17, upon initiation of driving of the feed roller set 32 (#24), the process proceeds directly to feed the recording medium 1 to the heating fixing unit HU without accumulation of the recording medium 1 at the second loop accumulating space J2. This means that the process jumps from step #24 shown in the flowchart of FIG. 8 to step #40 shown in the flowchart of FIG. 9. In this case, however, the recording medium transport speed by the pinching transport roller set 31 needs to be set substantially equal to the recording medium transport speed by the feed roller set 32.

Figure 18:
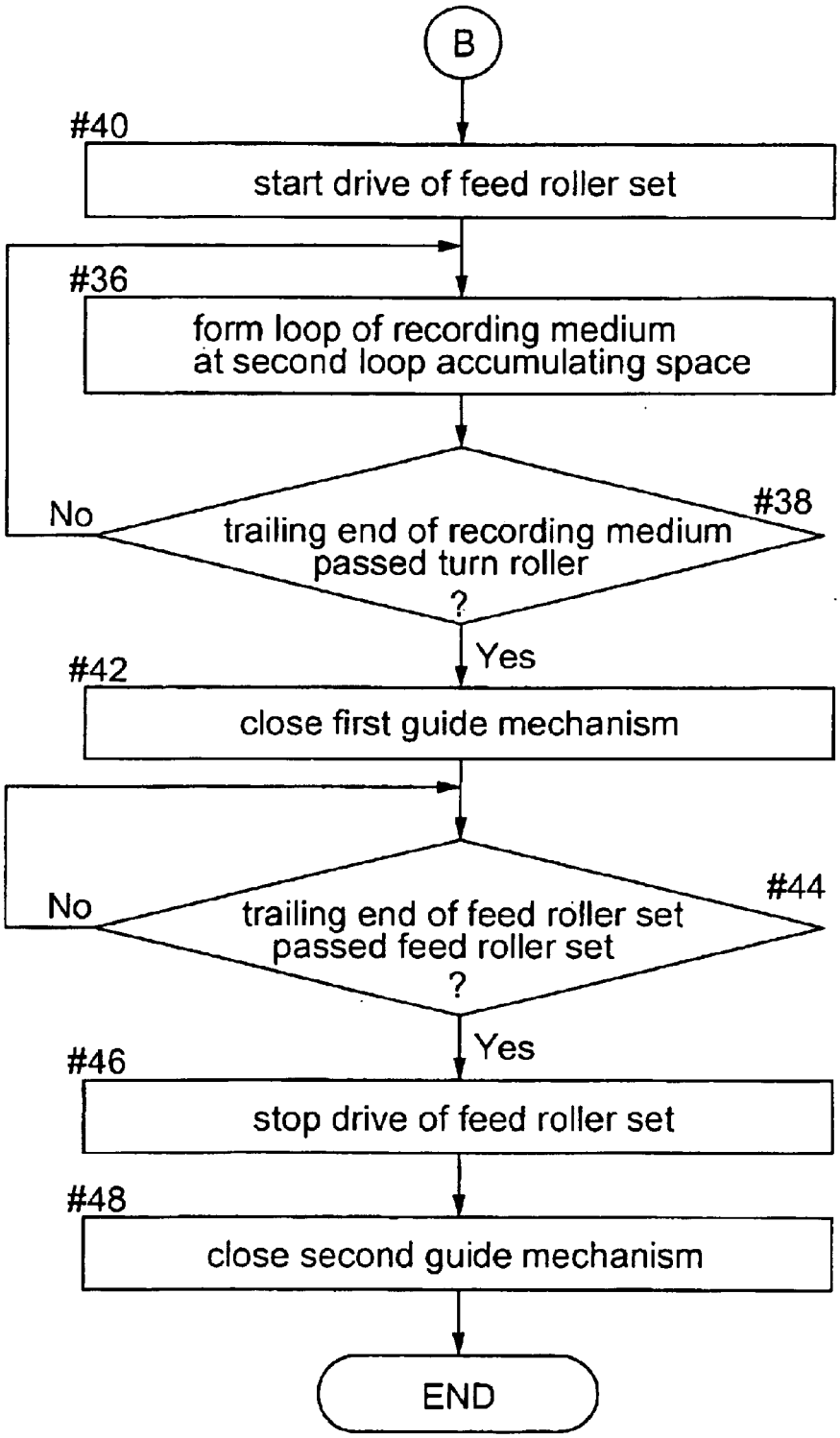
FIG. 18 is a flowchart illustrating an operation by the intermediate transporting mechanism in a different use.

According to another example, as shown in the flowchart of FIG. 18, the process drives the turn roller 31*a* at the high speed (#34) and also initiates driving of the feed roller set 32 (#40). Then, upon initiation of accumulation of the recording medium 1 at the second loop accumulating space J2, the process initiates feeding of the recording medium 1 to the heating fixing unit HU, thereby feed the recording medium 1 to the heating fixing unit HU while accumulating a certain length of the recording medium 1 at the second loop accumulating space J2 at the same time. This means putting step #40 before step #36 in the flowchart of FIG. 15. In this case, the recording medium transport speed by the pinching transport roller set 31 can be set higher than the recording medium transport speed by the feed roller set 32 by a degree not to result in excessive accumulation of the recording medium 1 at the second loop accumulating space J2. As a result, with this method, it is possible to empty the first loop accumulating space J1 sooner than the above-described method.

3. Image Fixing Formation Stage

After being subjected to a necessary timing adjustment at the loop-forming unit LU, the recording medium 1 having an image formed on its surface layer 12 is caused to pass the preliminary heating subunit PR and the main heating subunit R which are appropriately temperature-conditioned, during which the medium is exposed to thermal energy and with associated heating sublimation, the image formed on the surface layer 12 is transferred (fixed) to the fixing layer 11. Then, the recording medium 1 having undergone this heating fixing process will have its wrinkles developed during the heating process smoothed out by the ironing effect from the press roller mechanism 58 disposed at the exit of the heating fixing unit HU and acting as pressure applying means. Further, the recording medium will have its surface stretched and reshaped by the curved transporting section 59 to be introduced to the slow cooling unit CU.

Thereafter, the recording medium 1 introduced in the slow cooling unit CU will be transported downward along the surface of the slow cooling guide member 92 and pinched by the slow cooling intermediate transport roller pair 94. Then, the medium 1 will be returned to the substantially horizontal posture by means of the turn guide 95 and the discharge roller pair 96 disposed obliquely downwardly thereof and discharged to the outside. The discharged recording medium 1 will be stored within the stocker ST. Then, when appropriate, by removing the surface layer 12 from the medium, there will be obtained a finished printed product 100 having an image with clear color development.

Figure 19:
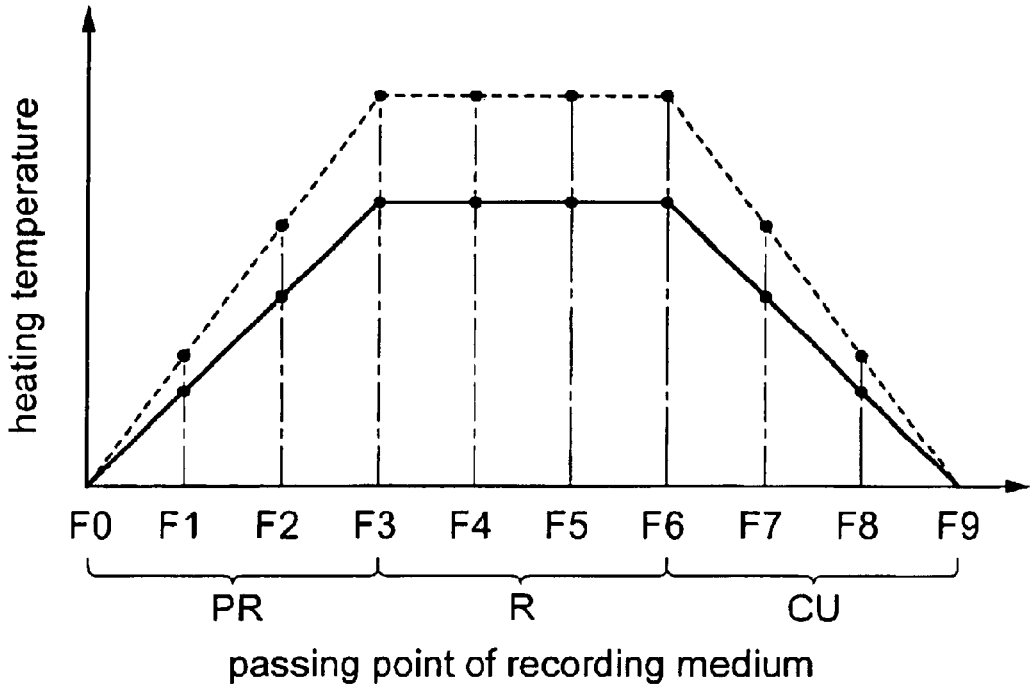
FIG. 19 is a graph illustrating a typical heating pattern of the heating unit.

Next, a typical heating pattern to which the recording medium 1 is subjected to in the slow cooling unit HU will be described with reference to FIG. 19.

In this, the heating pattern is represented in the form of a graph. The graph denotes passing points F0 to F9 of the recording medium 1 along the horizontal direction (horizontal axis) and heating temperatures at the respective passing points along the vertical direction (vertical axis). The passing points F1 and F2 belong in the preliminary heating subunit PR. The passing points F3 through F6 belong in the main heating subunit R. The passing points F7 and F8 belong in the slow cooling subunit CU. The other passing points F0 and F9 are out of the heating unit HU and their temperatures are a normal temperature (room temperature).

The heating temperatures at the points F3 through F6 are the temperatures at which the ink is sublimed and fixed. The preliminary heating subunit PR serves to elevate the temperature of the recording medium 1 from the normal temperature to the sublimating fixing temperature. The slow cooling subunit CU serves to lower the temperature of the recording medium 1 from the sublimating fixing temperature to the normal temperature. In other words, the temperatures of the preliminary heating subunit PR and the slow cooling subunit CU are lower than the temperature required for sublimation of the sublimating ink, thus causing substantially no sublimation thereof. In the case of this typical heating pattern, the sublimating fixing temperature Tn is set at 180° C. And, the passage period of the recording medium 1 through the main heating subunit R is set to about 2 minutes. Although the actual heating pattern will be varied depending on various printing conditions such as the type of the recording medium 1 to be employed, another heating pattern is denoted with dot line in FIG. 19.

What is claimed is:

1. An image forming apparatus comprising:

a printing unit having a print head for applying ink to a surface layer of a recording medium transported thereto;

a loop-forming unit capable of temporarily storing the recording medium discharged from the printing unit; and a heating unit for heating the recording medium fed from the loop-forming unit for fixing the ink applied to the surface layer onto its fixing layer;

wherein said heating unit includes a preliminary heating subunit for preliminarily heating the recording medium, and a main heating subunit for heating the recording medium at the ink fixing temperature level; and wherein each of said preliminary heating subunit and said main heating subunit includes a transport guide member for coming into face contact with the recording medium, and a heater disposed to be able to transfer its heat to the transport guide member.

2. The apparatus according to claim 1, wherein the heating unit further includes a slow cooling subunit for slowly cooling the recording medium to the normal temperature level.

3. The apparatus according to claim 2, wherein the heater of said slow cooling subunit comprises an electric wire which is arranged with a disposing density gradually reduced from the recording medium entrance to the recording medium exit of the slow cooling subunit.

4. The apparatus according to claim 1, wherein a cutter for cutting the recording medium is provided within the printing unit or between the printing unit and the loop-forming unit.

5. An image forming apparatus comprising a printing unit having a print head for applying ink to a surface layer of a recording medium transported thereto;

a loop-forming unit capable of temporarily storing the recording medium discharged from the printing unit; and a heating unit for heating the recording medium fed from the loop-forming unit for fixing the ink applied to the surface layer onto its fixing layer;

wherein said heating unit includes a preliminary heating subunit for preliminarily heating the recording medium, and a main heating subunit for heating the recording medium at the ink fixing temperature level; and wherein the printing unit includes a first transporting mechanism for transporting the recording medium while the heating unit includes a second transporting mechanism for transporting the recording medium; and said loop-forming unit is capable of absorbing a transportation speed difference between the first transporting mechanism and the second transporting mechanism.

6. The apparatus according to claim 5, wherein the transport speed of the first transporting mechanism is set higher than the transport speed of the second transporting mechanism.

7. An image forming apparatus comprising;

a printing unit having a print head for applying ink to a surface layer of a recording medium transported thereto;

a loop-forming unit capable of temporarily storing the recording medium discharged from the printing unit; and a heating unit for heating the recording medium fed from the loop-forming unit for fixing the ink applied to the surface layer onto its fixing layer;

wherein said heating unit includes a preliminary heating subunit for preliminarily heating the recording medium, and a main heating subunit for heating the recording medium at the ink fixing temperature level; and wherein the loop-forming unit includes an intermediate transporting mechanism for sending the recording medium received from the printing unit into the heating unit; and the intermediate transporting mechanism forms a first storage section and a second storage section each operable to store the recording medium while forming a loop thereof.

8. The apparatus according to claim 7, wherein the first storage section and the second storage section are disposed one after another along the transporting direction of the recording medium.

9. The apparatus according to claim 8, wherein the intermediate transporting mechanism includes a pinching transport roller set and a feed roller set, the first storage section being formed between a recording medium exit of the printing unit and the pinching transport roller set, the second storage section being formed between the pinching transport roller set and the feed roller set.

10. The apparatus according to claim 9, wherein the pinching transport roller set acts as a curl correcting roller for alleviating curling tendency of the recording medium.

11. The apparatus according to claim 10, wherein the pinching transport roller set is constituted from a turn roller having a larger diameter and a plurality of assist rollers disposed in spaced apart relationship along the peripheral face of the turn roller.

* * * * *